US007994441B2

(12) United States Patent
Asada

(10) Patent No.: US 7,994,441 B2
(45) Date of Patent: Aug. 9, 2011

(54) COMPOUND OPERATION INPUT DEVICE

(75) Inventor: Makoto Asada, Yao (JP)

(73) Assignee: Hosiden Corporation, Yao-shi (JP)

( * ) Notice: Subject to any disclaimer, the term of this patent is extended or adjusted under 35 U.S.C. 154(b) by 645 days.

(21) Appl. No.: 12/081,813

(22) Filed: Apr. 22, 2008

(65) Prior Publication Data

US 2008/0308401 A1 Dec. 18, 2008

(30) Foreign Application Priority Data

Jun. 11, 2007 (JP) ..... 2007-153873

(51) Int. Cl.
*H01H 9/00* (2006.01)

(52) U.S. Cl. ..... 200/4; 200/6 R

(58) Field of Classification Search ..... 200/4, 335, 200/339, 406

See application file for complete search history.

(56) References Cited

U.S. PATENT DOCUMENTS

| | | | | |
|---|---|---|---|---|
| 7,262,373 | B2 * | 8/2007 | Miura et al. | 200/4 |
| 7,635,817 | B2 * | 12/2009 | Asada | 200/14 |
| 2008/0047811 | A1 | 2/2008 | Yamanaka | |
| 2010/0300851 | A1 * | 12/2010 | Asada | 200/4 |

FOREIGN PATENT DOCUMENTS

| | | |
|---|---|---|
| JP | 03-055737 | 1/1993 |
| JP | 9-63416 | 3/1997 |
| JP | 3048274 | 2/1998 |
| JP | 10-112244 | 4/1998 |
| JP | 11-40003 | 2/1999 |
| JP | 2000-331569 | 11/2000 |
| JP | 2005-149738 | 6/2005 |
| JP | 2005-149925 | 6/2005 |
| JP | 2005-243546 | 9/2005 |
| JP | 2005-268010 | 9/2005 |

OTHER PUBLICATIONS

Japanese Office Action dated Feb. 9, 2010 (with its English translation).

Japanese Office Action dated Oct. 6, 2009 (with English translation).

* cited by examiner

*Primary Examiner* — Edwin A. Leon

*Assistant Examiner* — Lheiren Mae Caroc

(74) *Attorney, Agent, or Firm* — Kratz, Quintos & Hanson, LLP

(57) ABSTRACT

A compound operation input device includes a casing; an operating lever accommodatable in the casing in such a manner that the lever is depressingly operable from a neutral position in a pressing-movement direction and swingingly operable from the neutral position in two opposite swinging directions intersecting the pressing-movement direction; a position detector accommodatable in the casing and adapted to output a signal in accordance with a swing of the lever; a pressing member facing an end surface of the lever on the pressing-movement direction side; and a press switch facing the pressing member with a depressible portion of the switch facing a direction substantially orthogonal to the pressing-movement direction and the swinging directions of the lever. The pressing member is adapted to move toward the switch when pressed by the end surface of the lever so as to depress the depressible portion of the switch.

20 Claims, 18 Drawing Sheets

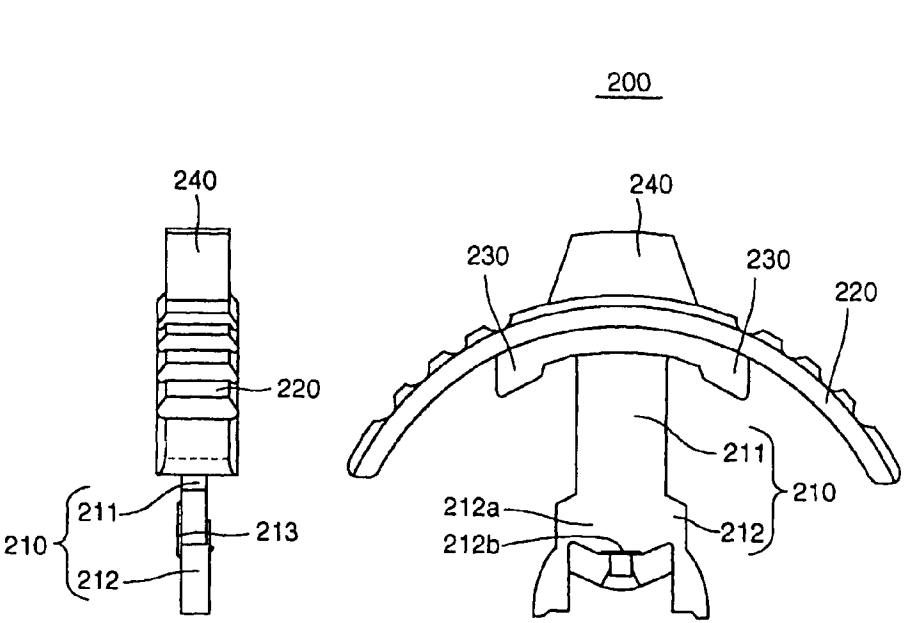
Fig.5B
Fig.5C
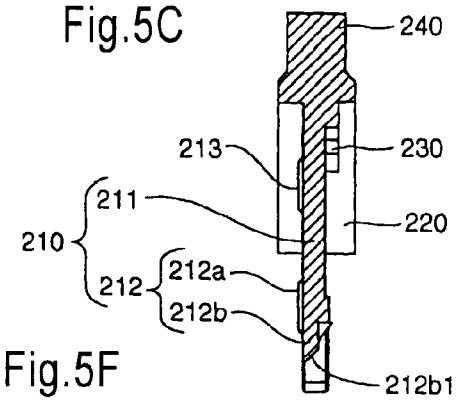
Fig.5F
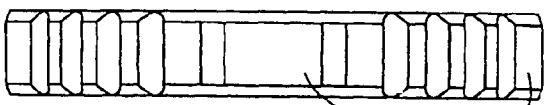
Fig.5D
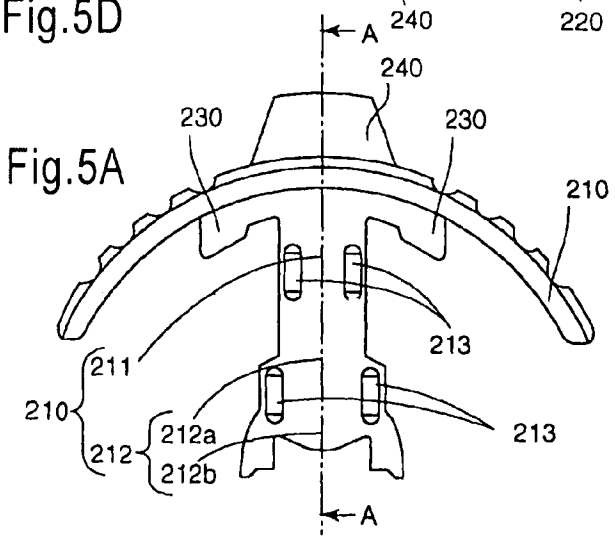
Fig.5A
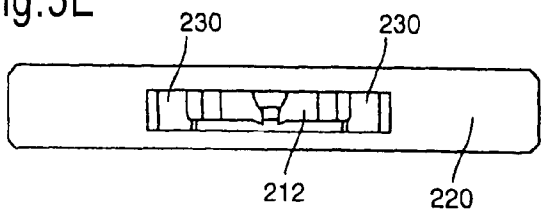
Fig.5E Fig.13A
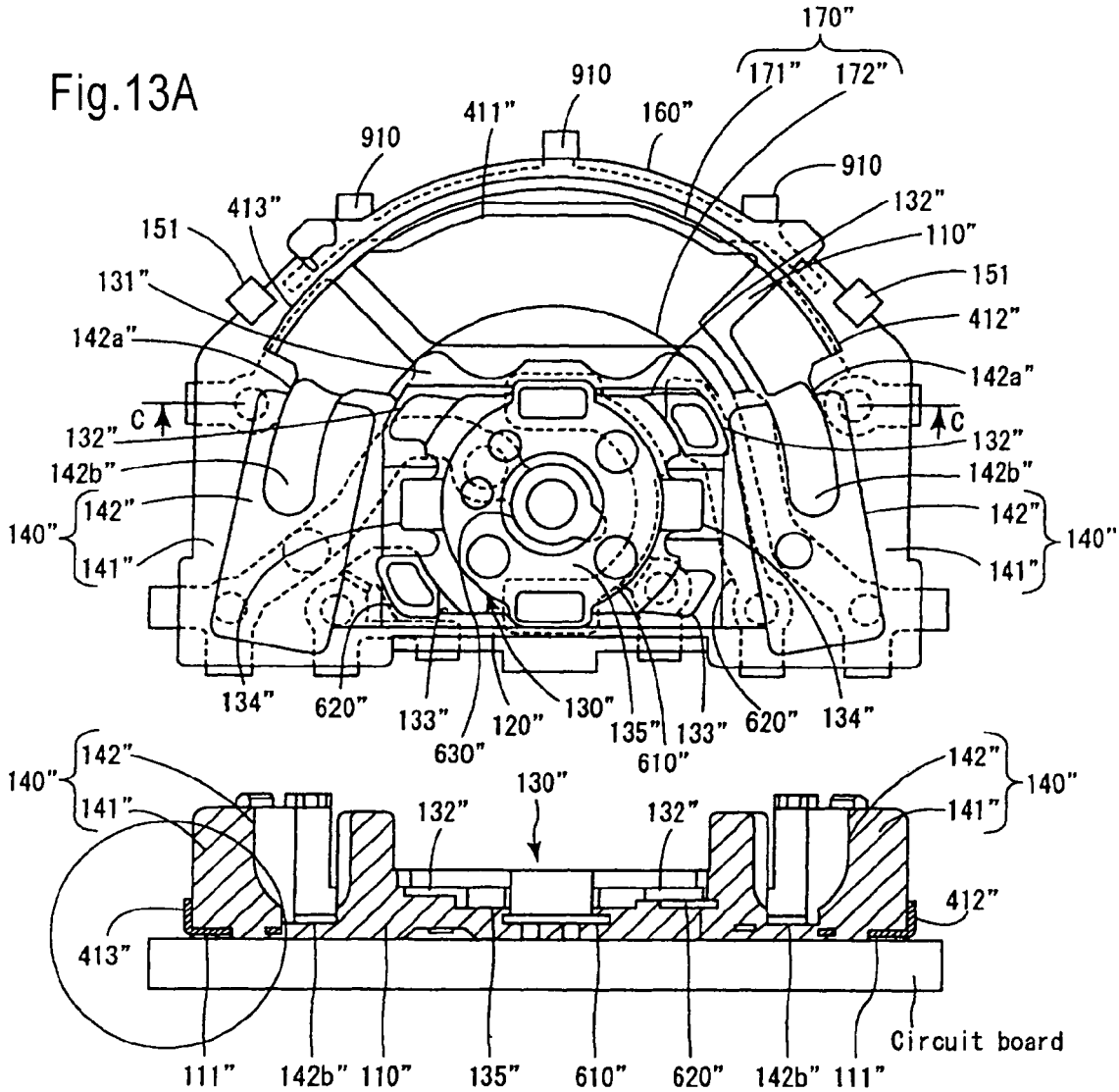
Fig.13B
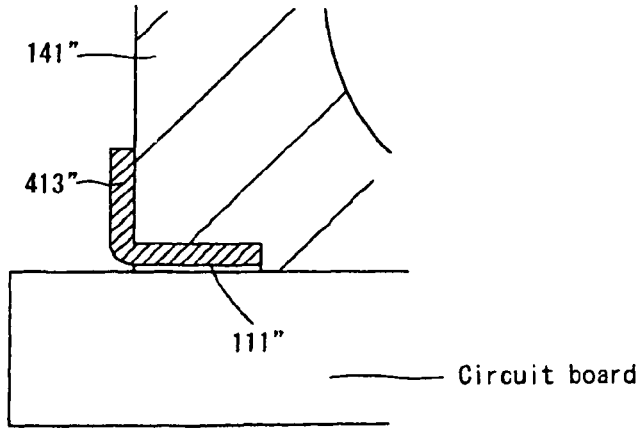
Fig.13C

300"

500"

Fig18A
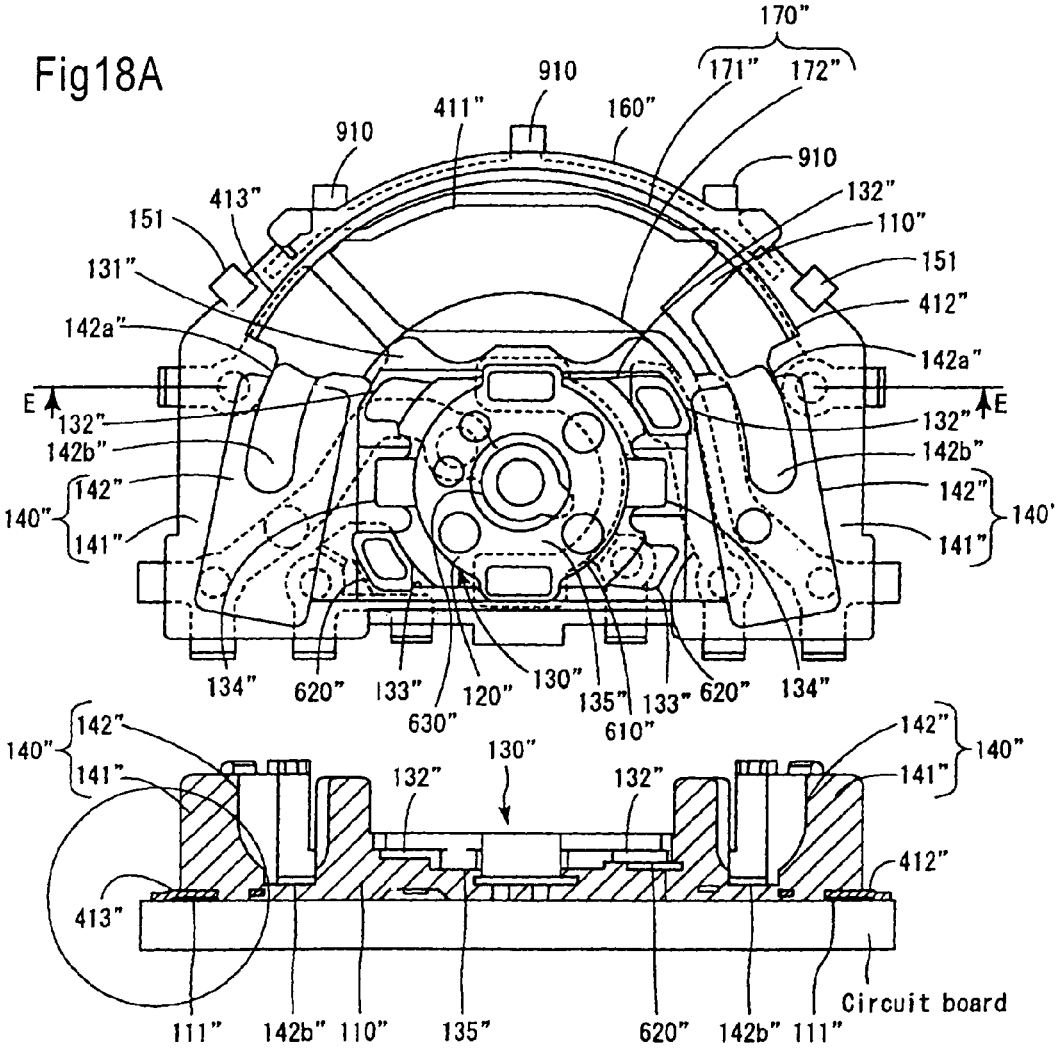
Fig18B
Fig18C
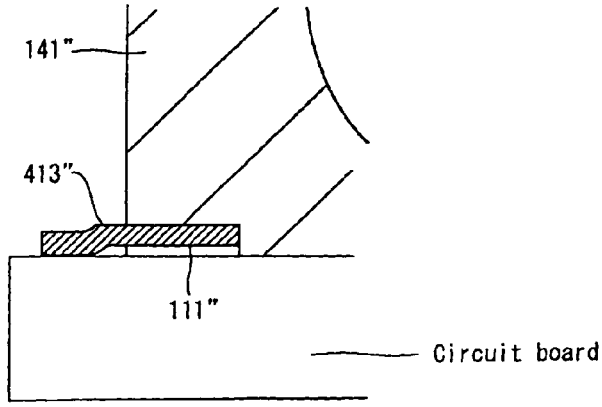

COMPOUND OPERATION INPUT DEVICE

The present application claims priority under 35 U.S.C. §119 of Japanese Patent Application No. 2007-153873 filed on Jun. 11, 2007, the disclosure of which is expressly incorporated by reference herein in its entity.

BACKGROUND OF THE INVENTION

1. Field of the Invention

The present invention relates to a compound operation input device having an operating lever that is swingingly operable from the neutral position in two opposite directions and pressingly operable from a neutral position.

2. Description of the Related Art

In a conventional compound operation input device of this type as disclosed in Japanese Unexamined Patent Publication No. 2005-149925, when the operating lever moves from the neutral position, swingingly to the right and left or downwardly by depression, the movable contact portion mounted on the operating lever moves and selectively comes into contact with associated two of four fixed contact portions arranged on the inner wall surface of a casing so as to output corresponding signals.

SUMMARY OF THE INVENTION

The conventional compound operation input device described above, however, poses a problem of poor tactile touch in depressing operation because the movable contact portion merely contact two fixed contact portions in the depression of the operating lever.

The present invention has been achieved in view of the circumstances described above, and the object thereof is to provide a compound operation input device with improved tactile touch in depressing operation.

In order to solve the problems described above, the present invention provides a compound operation input device including a casing; an operating lever accommodatable in the casing in such a manner that the operating lever is depressingly operable from a neutral position in a pressing-movement direction and swingingly operable from the neutral position in two opposite swinging directions intersecting the pressing-movement direction; a position detector accommodatable in the casing and adapted to output a signal in accordance with a swing angle of the operating lever; a pressing member facing an end surface of the operating lever on the pressing-movement direction side; and a press switch facing the pressing member with a depressible portion of the press switch facing a direction substantially orthogonal to the pressing-movement direction and the swinging directions of the operating lever. The pressing member is adapted to move toward the press switch when pressed by the end surface of the operating lever so as to depress the depressible portion of the press switch.

In such device, because the movement of the operating lever by depression causes the pressing member to move toward the press switch so as to depress the depressible portion of the press switch, superior tactile touch in pressing operation can be generated.

Also, the pressing member is arranged to face the end surface of the operating lever on the pressing-movement side while the press switch is arranged to face the pressing member with the switch's depressible portion facing a direction substantially orthogonal to the pressing-movement direction and the swinging directions of the operating lever. These arrangements allow the operating lever and the pressing member to be arranged in juxtaposition in the pressing-movement direction of the operating lever and the pressing member and the press switch to be arranged in juxtaposition in the orthogonal direction.

It is preferable that at least one of the end surface of the operating lever and a surface of the pressing member facing the operating lever forms a slope for moving the pressing member toward the press switch upon depression of the operating lever. In this case, the slope facilitates the movement of the pressing member toward the press switch in response to the depression of the operating lever.

The compound operation input device may further include two neutral position restoring members having resilience, being abuttable against the operating lever from the two swinging direction sides for holding the operating lever at the neutral position.

In the compound operation input device having this configuration, when the operating lever is swingingly operated in a swinging direction, an associated one of the neutral position restoration means is pressed and compressed against the operating lever. In turn, the operating lever is given a returning force to the neutral position. When the operating lever is swingingly operated in the other swinging direction, the operating lever presses and compresses the other neutral position restoration means. In turn, the operating lever is given a returning force to the neutral position.

Further, the casing accommodates the two neutral position restoration means on the respective two sides in the swinging directions of the operating lever. Therefore, the central part of the casing can be used as a space for accommodating the pressing member and the press switch. This arrangement is also effective in suppressing the increase in both height and thickness of the device which might be caused by the provision of the press switch.

In the case where the two neutral position restoring members includes two coil portions arranged on the two swinging direction sides of the operating lever in the casing, and two arm portions extending from the respective coil portions, the two arm portions may be pressed against associated opposite end portions in the swinging direction of the operating lever in response to a swinging motion of the operating lever so as to compress the respective two coil portions.

Specifically, when the operating lever is swingingly operated in a swinging direction, an end portion thereof presses an associated one of the arm portions. As a result, the associated coil portion is compressed, and the operating lever is given the returning force to the neutral position. When the operating lever is swingingly operated in the other swinging direction, the other end portion thereof presses the other arm portion. As a result, the second coil portion is compressed, and the operating lever is given a returning force to the neutral position.

The compound operation input device may further includes a substantially arcuate rotor, the operating lever coupled thereto movably in the pressing-movement direction of the operating lever, the rotor being held in the casing swingably together with the operating lever. In this case, the two arm portions are adapted to be pressed against associated two end portions of the rotor in response to swinging motions of the operating lever so as to compress the respective two coil portions.

More specifically, when the operating lever is swingingly operated in a swinging direction, an associated one end portion of the rotor presses an associated one of the arm portions. As a result, the associated coil portion is compressed, and the rotor and the operating lever are given the returning force to the neutral position. If the operating lever is swingingly operated in the other swinging direction, the other end portion of the rotor presses the other arm portion. As a result, the other coil portion is compressed, and the rotor and the operating lever are given a returning force to the neutral position.

The two neutral position restoration means are preferably integrated by another arm portion extending from and coupling between the two coil portions.

As an alternative, the neutral position restoration means may be so configured as to abut respective two end portions of the rotor from the two swinging directions so as to hold the rotor at the neutral position.

As another alternative, in the case where the compound operation input device includes a neutral position restoring member having resilience for restoring the swinging-operated operating lever to the neutral position, the operating lever may include two first abutting portions abuttable against portions of lengthwise opposite end surfaces of the neutral position restoring member. The casing may include two second abutting portions abuttable against the remaining portions of the two lengthwise end surfaces of the neutral position restoring member.

In this compound operation input device, the swing motion of the operating lever in a swinging direction causes the neutral position restoration means to be compressed between a second one of the first abutting portions and a first one of the second abutting portions. As a result, the operating lever is given the returning force to the neutral position. On the other hand, a swing motion of the operating lever in the other swinging direction causes the neutral position restoration means to be compressed between the first one of the first abutting portions and the second one of the second abutting portions. As a result, the operating lever is given the returning force to the neutral position.

It is also advantageous that the neutral position restoration means, just retained between the first and second abutting portions, takes only a small accommodation space in the casing. This arrangement further contributes to compactness of the input device.

In the case where a substantially arcuate rotor, the operating lever coupled thereto movably in the pressing-movement direction of the operating lever, the rotor being held in the casing swingably together with the operating lever, the rotor may include an accommodating concavity for accommodating the neutral position restoring member with the remaining part thereof exposed. Lengthwise opposite end surfaces of the accommodating concavity constitute the two first abutting portions. By thus accommodating the neutral position restoration means in the accommodating concavity, the neutral position restoration means can be easily built in.

The press switch may include first and second fixed contact portions arranged on the casing, and a substantially dome-shaped movable contact portion whose top portion serves as the depressible portion and whose peripheral edge portion is contactable with the first fixed contact portions. In this case, upon depression of the pressing member, the movable contact portion may be elastically deformed so that the top portion thereof is brought into contact with the second fixed contact portion.

In the case where the pressing member is elastically deformable, once the movable contact portion is released from the depression of the operating lever, the pressing member and the movable contact portion may be restored so as to push the operating lever toward the neutral position.

The first fixed contact portion may include a first end portion exposed inside the casing to contact the peripheral edge portion of the movable contact portion and a second end portion projected out of the casing for external connection, while the second fixed contact portion may include a first end portion exposed in the casing and adapted to contact the movable contact portion and a second end portion projected out of the casing for external connection. In this case, a plurality of connecting concavities for receiving solder may be formed in portions of the casing from which the second end portions of the first and second fixed contact portions are projected. In this case, simply by pouring solder into the connecting concavities of the casing set on the circuit board, the second end portions of the first and second fixed contact portions can be connected and soldered to a circuit board. Another advantage is that the compound operation input device can be fixed to the circuit board more securely because not only the second end portions of the first and second fixed contact portions but also the connecting concavity of the casing are to be soldered to the circuit board.

As still another alternative, the press switch may include first, second and third fixed contact portions arranged on the casing, a substantially dome-shaped first movable contact portion whose peripheral edge portion is contactable with the first fixed contact portion, and a substantially dome-shaped second movable contact portion disposed over the first movable contact portion, the peripheral edge of the second movable contact portion being contactable with the second fixed contact portion. In this case, a second top portion of the second movable contact portion may serve as the depressible portion, and upon depression of the second top portion by the pressing member, the second movable contact portions may be elastically deformed and the second top portion thereof may come into contact with a first top portion of the first movable contact portion. Upon further depression of the second top by the pressing member, the first and second movable contact portions may be elastically deformed and the first top portion may come into contact with the third fixed contact portion.

In the case where the pressing member is elastically deformable, once the second movable contact portion is released from the depression of the operating lever, the pressing member and the second movable contact portion may be restored so as to push the operating lever toward the neutral position. Once the first and second movable contact portions are released from the depression of the operating lever, the pressing member and the first and second movable contact portions may be restored so as to push the operating lever toward the neutral position. In this way, the operating lever depressed can be restored to the neutral position.

The first fixed contact portion may include a first end portion exposed inside the casing to contact the peripheral edge portion of the first movable contact portion, and a second end portion projected out of the casing for external connection. The second fixed contact portion may include a first end portion exposed inside the casing and to contact the peripheral edge portion of the second movable contact portion, and a second end portion projected out of the casing for external connection. The third fixed contact portion including a first end portion exposed in the casing in a way adapted to contact the first movable contact portion, and a second end portion projected out of the casing for external connection. In this configuration, a plurality of connecting concavities for receiving solder may be formed in portions of the casing from which the second end portions of the first, second and third fixed contact portions are projected. Consequently, simply by pouring the solder into the connecting concavities of the casing set on the circuit board, the second end portions of the first, second and third fixed contact portions can be soldered to the circuit board. In this way, the compound operation input device can be fixed to the circuit board more securely because not only the second end portions of the first, second and third fixed contact portions but also the connecting concavities of the casing are soldered to the circuit board.

The position detector may include a conductive brush arranged on the operating lever and a plurality of contact portions arranged on the casing and selectively contacted by the conductive brush. As an alternative, the position detector may include a conductive brush arranged on the rotor and a plurality of contact portions arranged on the casing and selectively contacted by the conductive brush.

In the case where a plurality of contact portions each include a first end portion exposed inside the casing and adapted to be contacted by the conductive brush and a second end portion projected out of the casing for external connection, a plurality of connecting concavities for receiving solder may be formed in portions of the casing from which the second end portions of the plurality of the contact portions are projected. In this case, the second end portions of the contact portions can be soldered to the circuit board simply by pouring the solder into the connecting concavities of the casing set on the circuit board. The compound operation input device can be fixed to the circuit board more securely because not only the second end portions of the contact portions but also the connecting concavities of the casing are connected by soldering to the circuit board.

The compound operation input device may preferably further include a frame ground mountable on the casing to release static electricity charged on the operating lever outside the input device.

The compound operation input device according to the present invention provides an improved tactile touch in depressing operation of the operating lever due to the configuration that the depression of the operating lever moves the pressing member toward the press switch so as to depress the depressed member of the press switch.

In addition, the operating lever is arranged in juxtaposition with the pressing member in the pressing-movement direction of the operating lever, while arranging the pressing member and the press switch in juxtaposition in the aforementioned orthogonal direction. Thus, the increase in both height and thickness of the device which might be caused by the provision of the press switch can be suppressed, thereby reducing the size of the device.

BRIEF DESCRIPTION OF THE DRAWINGS

FIG. 1 is a schematic front view showing a compound operation input device according to a first embodiment of the present invention, in which

FIG. 2 is a schematic front view showing a state where the frame ground of the device is removed, in which

FIG. 5 is a diagram showing the operating lever of the device, in which FIG. 5A is a front view, FIG. 5B is a rear view, FIG. 5C is a side view, FIG. 5D is a plan view, FIG. 5E is a bottom view, and FIG. 5F is a sectional view taken in line A-A;

FIG. 6 is a schematic sectional view showing the operating lever, the depression member proper and the push-down switch, in which

FIG. 7 is a diagram showing the compound operation input device according to a second embodiment of the present invention, in which

FIG. 13 is a diagram of the case showing the exposed portions of the fixed contact portions of the push-down switch, the contacts of the position detecting device and the earth terminals of the device, in which FIG. 13A is a front view, FIG. 13B is a sectional view taken in line C-C, and FIG. 13C is a partly enlarged view of FIG. 13B;

FIG. 14 is a diagram showing the operating lever of the device, in which

FIG. 17 is a schematic front view showing a state where the frame ground of the device is removed, in which FIG. 18 is a diagram of the casing showing the fixed contact portions of another push-down switch, the contacts of the position detecting device and the earth terminals of the device, in which FIG. 18A is a front view, FIG. 18B is a sectional view taken in line E-E, and FIG. 18C is a partly enlarged view of FIG. 18B.

DESCRIPTION OF THE PREFERRED EMBODIMENTS

Descriptions will now be made in detail to the present preferred embodiments of the present invention.

Embodiment 1

Figure 1A:
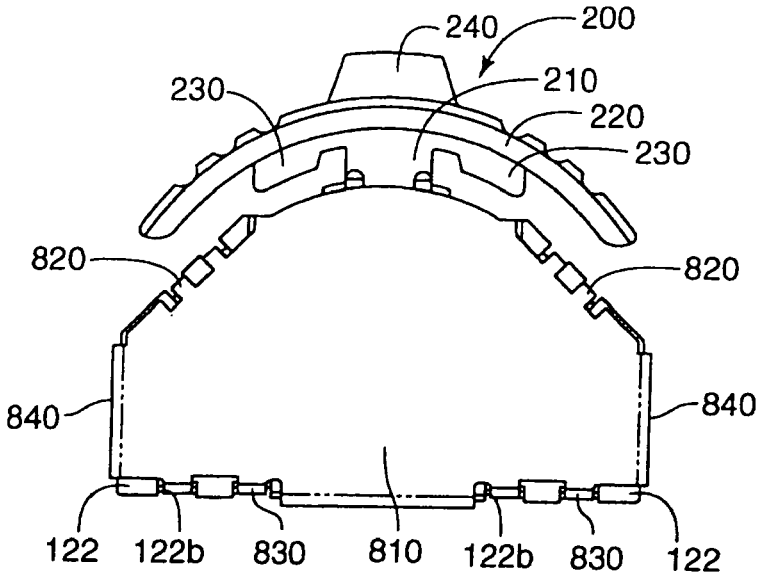
FIG. 1A is a diagram showing a state where the operating lever is located at the origin.
Figure 1B:
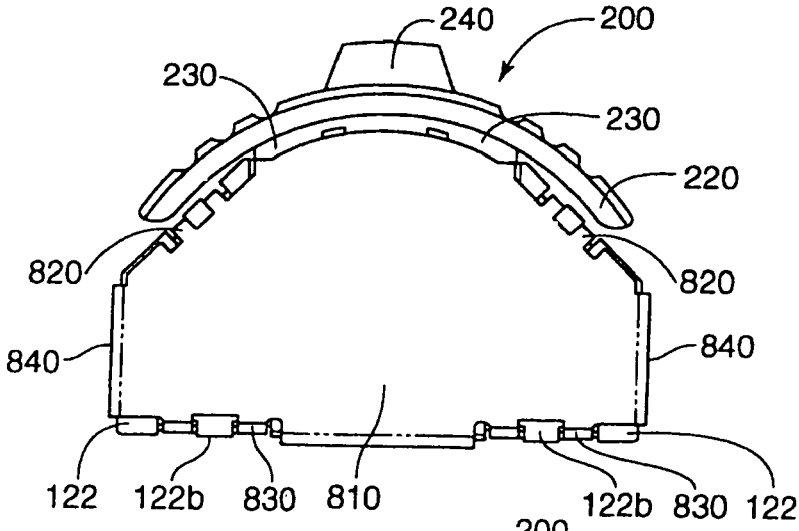
FIG. 1B is a diagram showing a state where the operating lever is depressed.
Figure 1C:
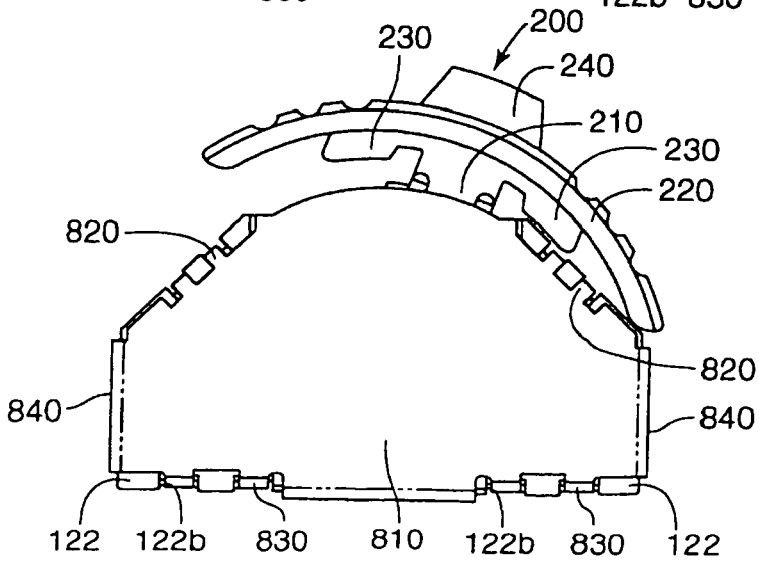
FIG. 1C is a diagram showing a state where the operating lever is in swing operation.
Figure 2A:
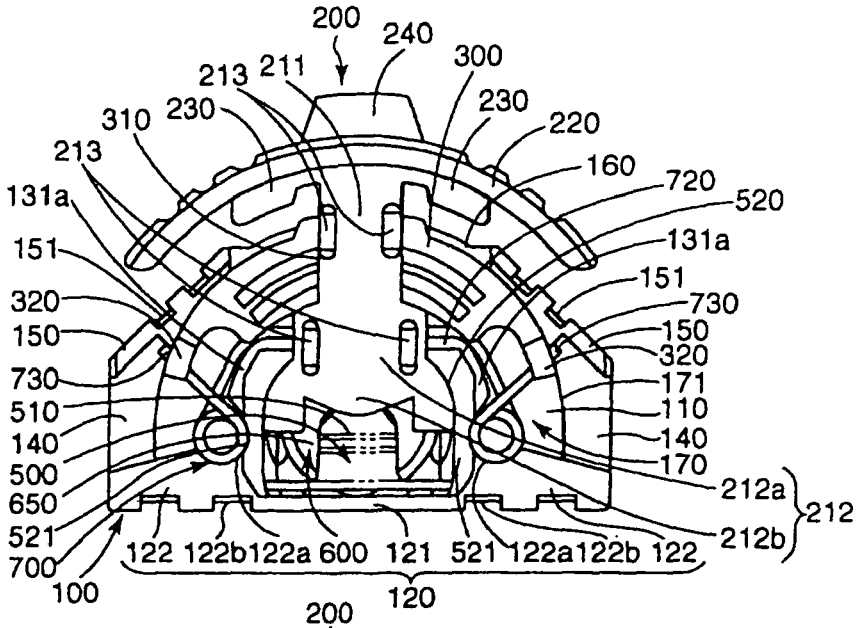
FIG. 2A is a diagram showing a state where the operating lever is located at the origin.
Figure 2B:
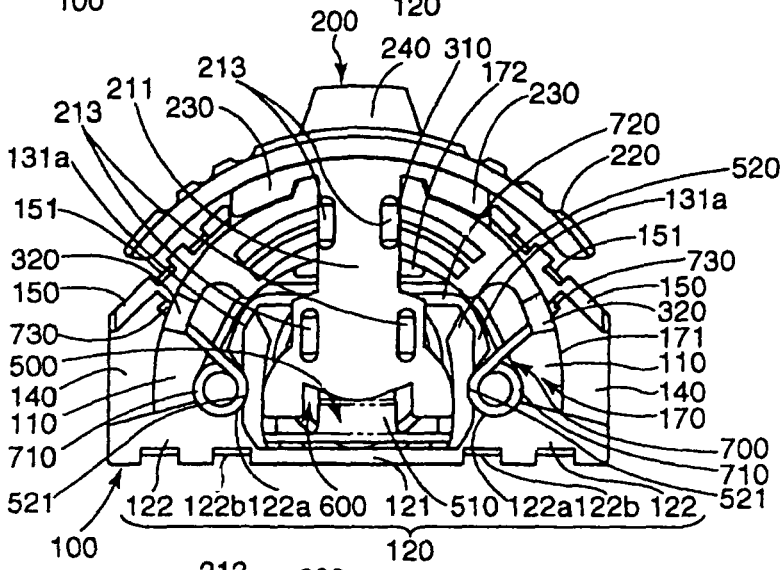
FIG. 2B is a diagram showing a state where the operating lever is depressed.
Figure 2C:
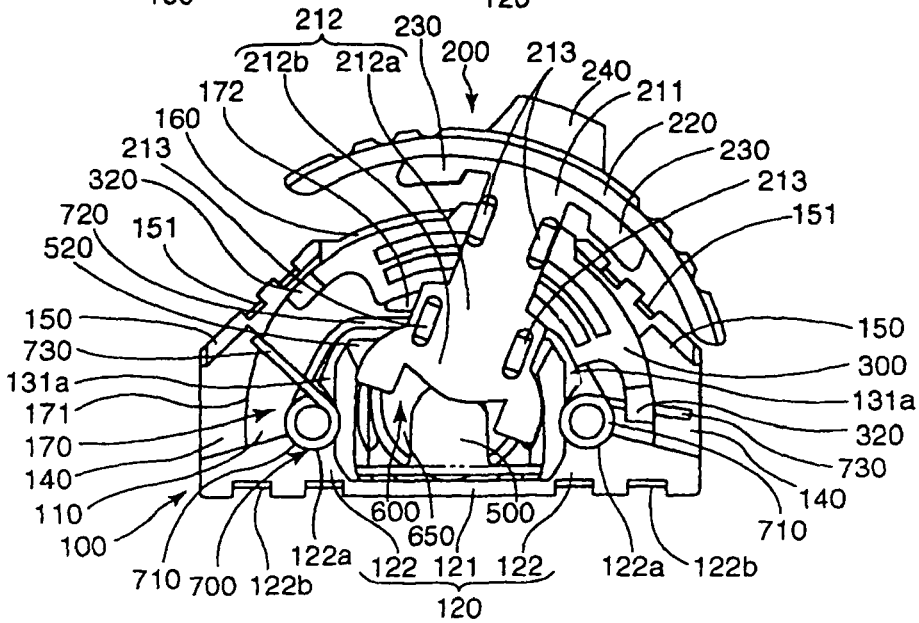
FIG. 2C is a diagram showing a state where the operating lever is in swing operation.
Figure 3:
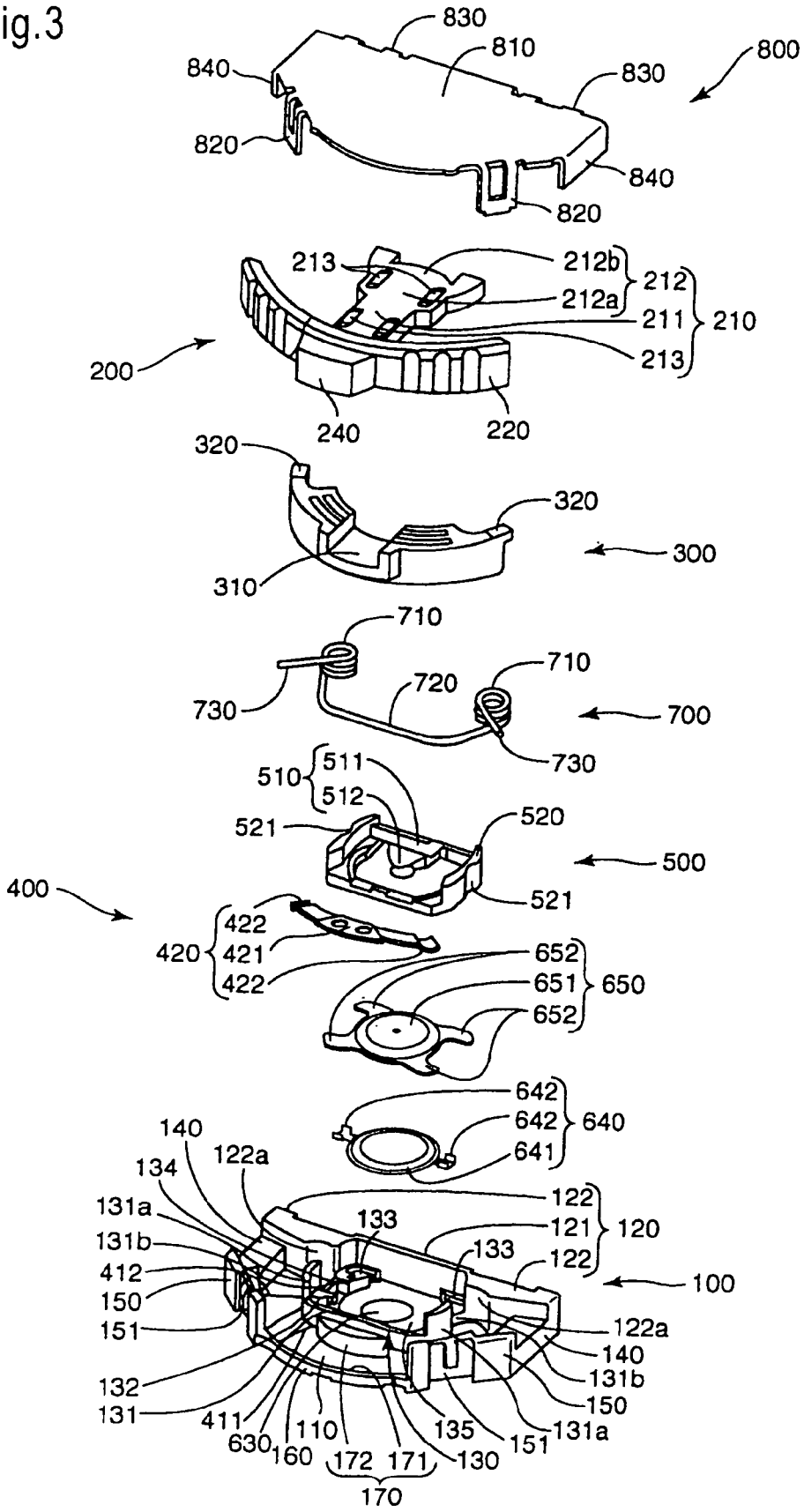
FIG. 3 is an exploded perspective view schematically showing the device.
Figure 6C:
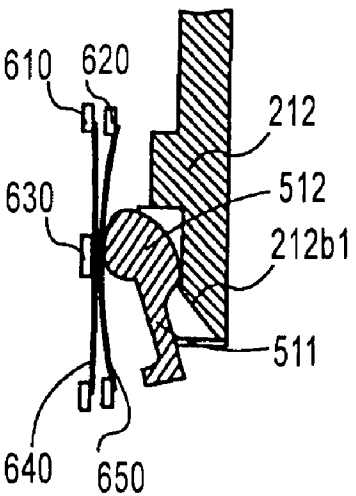
FIG. 6C is a diagram showing a state where the push-down switch is in the second stage of depression.
Figure 6B:
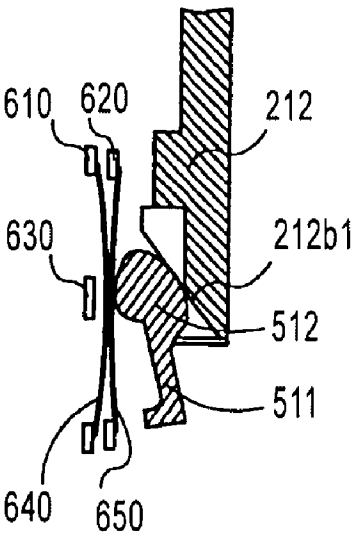
FIG. 6B is a diagram showing a state where the push-down switch is in the first stage of depression.
Figure 6A:
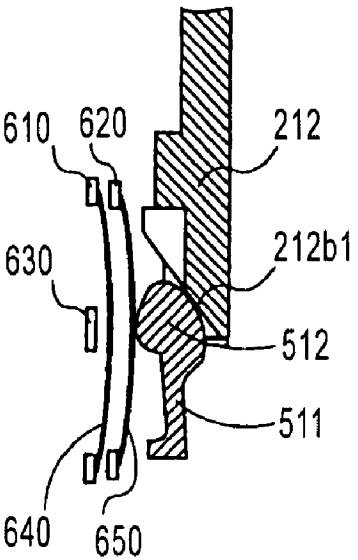
FIG. 6A is a diagram showing the state before depression of the push-down switch.
Figure 7B:
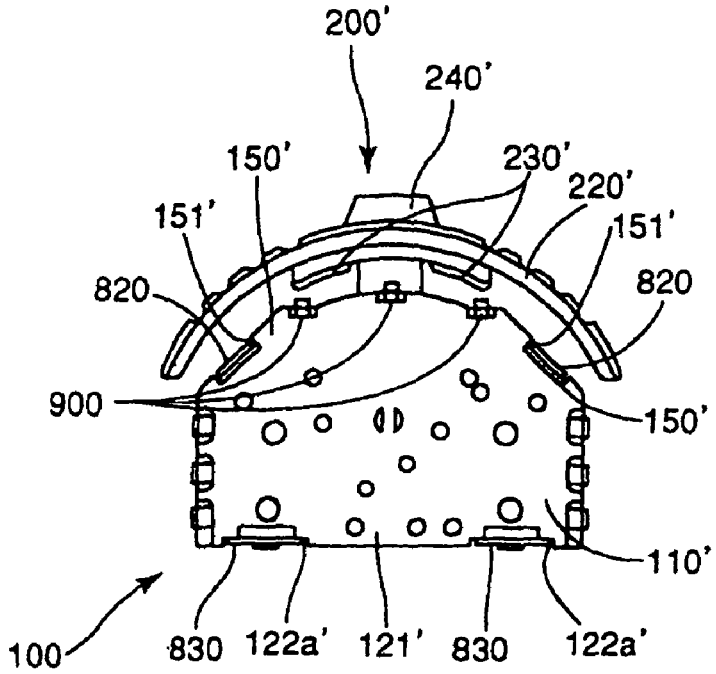
FIG. 7B is a schematic rear view.
Figure 7C:
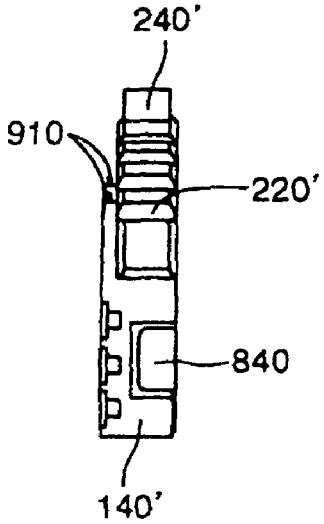
FIG. 7C is a schematic side view.
Figure 7A:
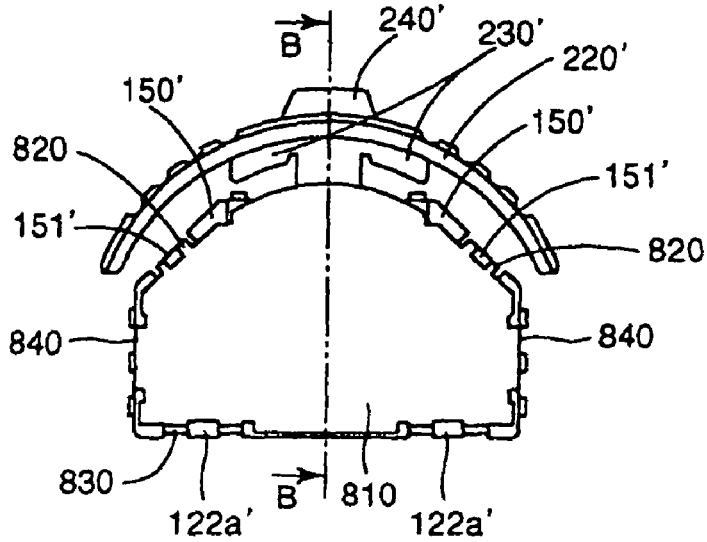
FIG. 7A is a schematic front view.
Figure 7D:
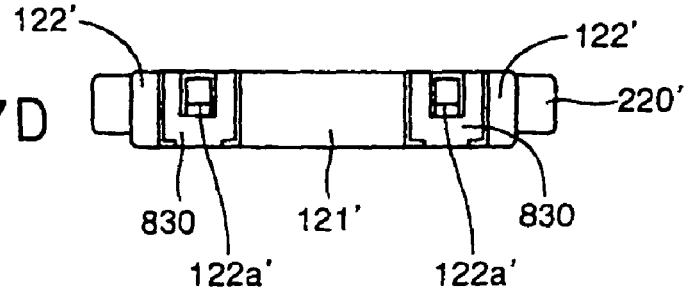
FIG. 7D is a schematic bottom view.

First, the compound operation input device according to a first embodiment of the present invention is explained with reference to the drawings. FIG. 1 is a schematic front view of the compound operation input device according to the first embodiment of the present invention. In FIG. 1, (a) is a diagram showing a state where an operating lever is located at the neutral position, (b) a diagram showing a state where the operating lever is depressed, (c) a diagram showing a state where the operating lever is in swing motion. FIG. 2 is a schematic front view showing the device a state where the frame ground of is removed. In FIG. 2, (a) is a diagram showing a state where the operating lever is located at the neutral position, (b) a diagram showing a state where the operating lever is depressed, and (c) a diagram showing a state where the operating lever is in swing motion. FIG. 3 is an exploded perspective view schematically showing the device, FIG. 4 a schematic diagram of a casing showing the exposed parts of the fixed contact portions of a press switch and the contacts of a position detector of the device. FIG. 5 is a diagram showing the operating lever of the device. In FIG. 5, (a) is a front view, (b) a rear view, (c) a side view, (d) a plan view, (e) a bottom view and (f) a sectional view taken in line A-A. FIG. 6 is a schematic sectional view showing the operating lever, a pressing member proper and the press switch of the device. In FIG. 6, (a) is a diagram showing a state before the press switch is depressed, (b) a diagram showing the first stage of depression of the press switch and (c) a diagram showing the second stage of depression of the press switch.

The compound operation input device shown in this embodiment is an input device to be installed in a digital camera. The input device includes a casing 100; an operating lever 200 held in the casing, movable by depression (i.e. adapted for shutter operation) in two stages from the neutral position, and swingable (i.e. in a way adapted for zoom operation) from the neutral position in two opposite swinging directions intersecting the pressing-movement direction; a rotor 300 with the operating lever 200 mounted movably downward thereon, a position detector 400 for outputting a signal corresponding to the swing of the operating lever 200, a pressing member 500 arranged under the operating lever 200, a press switch 600 arranged to face the pressing member 500, an neutral position restoration means 700 (two pieces of neutral position restoration means are integrated into one piece) for restoring the operating lever 200 as swinging operated to the neutral position, and a frame ground 800 mounted on the casing 100. Each of these elements is described in detail below.

The casing 100 is molded of plastics material as shown in FIGS. 1, 2, 3 and 4. This casing 100 includes a substantially pentagonal tabular base portion 110 having a round top, a bottom wall portion 120 arranged at the lower end of a first surface in the thickness direction of the base portion 110, a switch accommodating portion 130 arranged in the center of the first surface of the base portion 110, two side wall portions 140 arranged on the respective opposite ends of the first surface of the base portion 110, two inclined wall portions 150 arranged on respective two slopes of the first surface of the base portion 110, an arcuate wall portion 160 arranged at the top of the first surface of the base portion 110, and a guide portion 170 for guiding the rotor 300 swingably in the same direction as the operating lever 200.

The bottom wall portion 120, as shown in FIGS. 2 and 3, includes a rectangular bottom plate portion 121 located in the center of the lower end of the first surface of the base portion 110 and two substantially triangle pole-shaped hill portions 122 integrally connected to the opposite ends of the bottom plate portion 121.

Top portions of the hill portions 122 are each formed with substantially arcuate first coil accommodating concavities 122*a* for accommodating portions of the coil portions 710 of the neutral position restoration means 700. Also, lower surfaces of the hill portions 122 are provided with lower engaging portions 122*b* adapted to engage lower engaging pieces 830 of the frame ground 800.

This lower engaging portions 122*b* each include a rectangular concavity formed in the lower surface of the corresponding hill portion 122 and an engaging protrusion arranged in the center of the concavity.

As shown in FIGS. 2 and 3, the outer surfaces of inclined wall portions 150 have upper engaging portion 151 for engaging corresponding upper engaging pieces 820 of the frame ground 800. The upper engaging portions 151 each include a rectangular concavity formed in the upper surface of the corresponding inclined wall portion 150 and an engaging protrusion formed in the center of the concavity.

The side wall portions 140 are continuous to the hill portions 122 of the bottom wall portion 120 and the inclined wall portions 150. The height of the side wall portions 140 is smaller than the heights of the bottom wall portions 120 and the inclined wall portions 150.

The guide portion 170 includes a substantially semi-circular guide surface 171 formed as the inner surfaces of the side wall portions 140, the inclined wall portions 150 and the arcuate wall portion 160, and a substantially semi-circular cylindrical guide protrusion 172 arranged above the switch accommodating portion 130 on the first surface of the base portion 110 for guiding the rotor 300 swingably between itself and the guide surface 171. Incidentally, the space between the lower surface of the guide protrusion 172 and the upper surface of the switch accommodating portion 130 is used to accommodate a middle portion of a first arm portion 720 of the neutral position restoration means 700.

Figure 4:
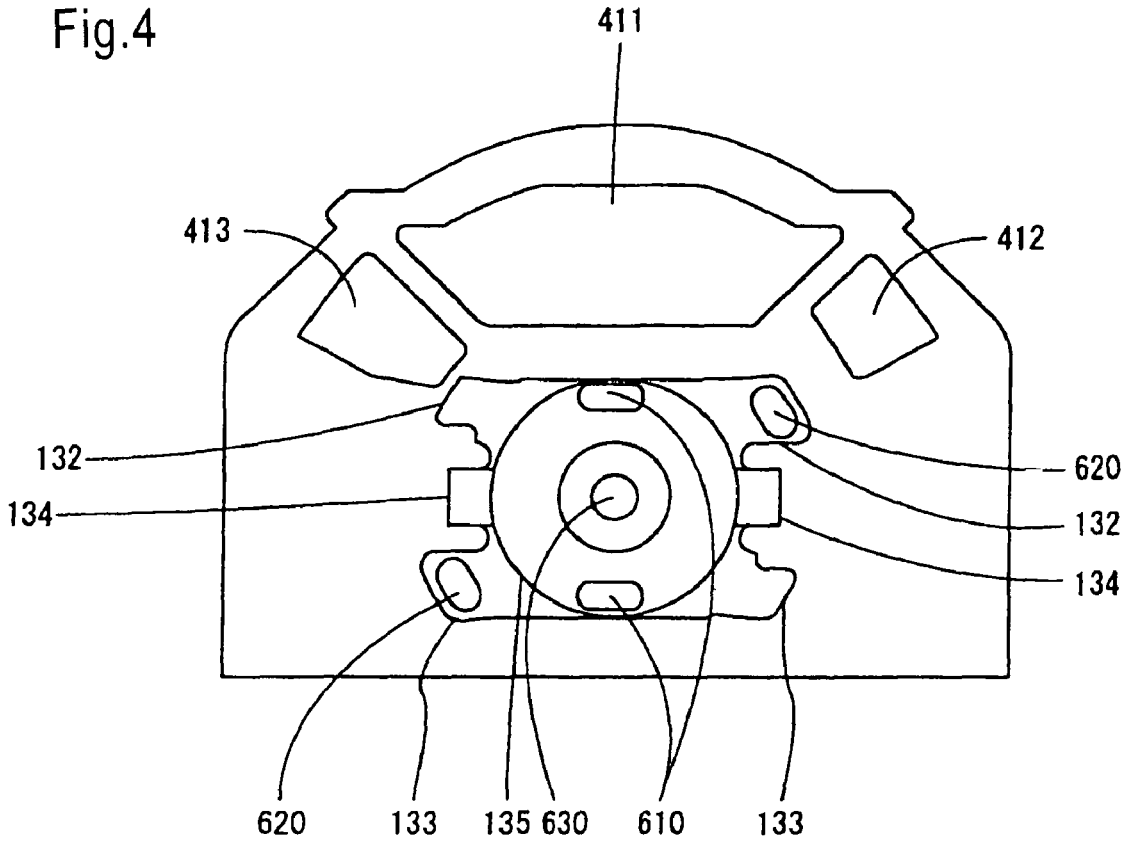
FIG. 4 is a schematic diagram of the case showing the exposed parts of the fixed contact portions of the push-down switch and the contact portions of the position detecting device of the device.

The switch accommodating portion 130, as shown in FIGS. 3 and 4, includes a ridge 131 of an inverted U-shape integrally connected with the two hill portions 122, two first support portions 132 protrudingly provided inside the respective two corners of the ridge 131, two second support portions 133 protrudingly provided inside the respective parts connecting between the two hill portions 122 and the two ends of the bottom plate portion 121, two third support portions 134 (only one of them is shown) concavely provided between the first support portions 132 and the second support portions 133, and a contact mounting portion 135 arranged in the center of the switch accommodating portion 130.

Two fixing arms 131*a* are protruded at the respective two corners of the ridge 131. The fixing arms 131*a* are substantially triangle pole-shaped and located above the first coil accommodating concavities 122*a*. The inner surfaces of the fixing arms 131*a* are concaved to fixedly position respective two upper corners of a frame 520 of the pressing member 500. The outer surfaces of the fixing arm 131*a* are inclined to guide the first arms 720 extending from the coil portions 710 of the neutral position restoration means 700 accommodated in the first coil accommodating concavities 122*a*.

Also, the fixing arms 131*a* are abuttable against stoppers 212*a* of the operating lever 200, and has the function of restricting the range of the swing motion of the operating lever 200.

Also, on the outer surfaces of the two ends of the ridge 131, there are two substantially arcuate second coil accommodating concavities 131*b*, continuous to the two first coil accommodating concavities 122*a*.

The second coil accommodating concavities 131*b* accommodate and hold different parts of the coil portions 710 of the neutral position restoration means 700.

As shown in FIG. 3, concavities for supporting four second leg portions 652 of a second movable contact portion 650 are arranged on the surfaces of two each of the first and second support portions 132, 133.

Two third support portions 134 are adapted to support two first leg portions 642 of a first movable contact portion 640.

The operating lever 200, as shown in FIGS. 2, 3 and 5, includes a rod-like shaft portion 210, a substantially arcuate operating arm 220 arranged at the upper end of the shaft portion 210, two guide protrusions 230 arranged on the lower surface of the operating arm 220 and integrally connected to two widthwise ends of the shaft portion 210, and a substantially trapezoidal operating protrusion 240 arranged in the center of the upper surface of the operating arm 220.

The shaft portion 210 includes a substantially prismatic mounting portion 211 to fit vertically movably in a mounting concavity 310 of the rotor 300, a depressing portion 212 integrally connected to the lower end of the mounting portion 211, and four protrusions 213 arranged on the first thicknesswise surface of the mounting portion 211 and the depressing portion 212.

The depressing portion 212 includes the stopper 212*a* integrally connected to the lower end of the mounting portion 211 and being wider than the mounting portion 211, and a substantially semicircular pressing portion main body 212*b* integrally connected to the lower end of the stopper 212*a*.

The two upper corners of the stopper 212*a* is inclined diagonally outward. These two corners of the stopper 212*a* are adapted to abut the lower surface of the rotor 300 so as to prevent the operating lever 200 from coming off upward.

The central part of the lower end of the pressing portion main body 212*b* is notched into such a shape that two substantially right-angled triangles are connected at an acute angle thereof as viewed from the front. Also, the central part of the lower end of the pressing portion main body 212*b* (i.e., an end surface on the pressing-movement direction side), as shown in FIGS. 5(*f*) and 6, has a slope 212*b*1 progressively descending from the second end surface toward the first end surface in the thickness direction thereof.

As shown in FIG. 6(*a*), the slope 212*b*1 is abuttable against a pressing member main body 510 of the pressing member 500. Specifically as shown in FIGS. 6(*b*) and 6(*c*), the slope 212*b*1 depresses a head portion 512 of the pressing member 500 in accordance with depression of the operating lever 200 and moves the head portion 512 toward the press switch 600. Also, the part of the slope 212*b*1 in contact with the pressing member main body 510 serves as a supporting point in the swing motion of the operating lever 200.

The upper surfaces of the opposite ends of the operating arm 220 are made uneven to facilitate the operation.

Also, the sum of the widths of the two guide protrusions 230 and the width of the mounting portion 211 of the shaft portion 210 is somewhat smaller than the length between the inner surfaces of the two inclined wall portions 150 as shown in FIG. 2. Specifically, the outer surfaces of the guide protrusions 230, as shown in FIG. 2(*b*), are guided by the inner surfaces of the inclined wall portions 150 of the casing 100 as the operating lever 200 moves by depression.

The rotor 300, as shown in FIGS. 2 and 3, is a substantially arcuate member. The central part of the first surface in the width direction of the rotor 300 is formed with the mounting concavity 310 in which the mounting portion 211 of the operating lever 200 is fitted movably in vertical direction. The second surface in the width direction of the rotor 300 is formed with two bosses, not shown, welded to the two mounting holes in a body 421 of a brush 420 of the position detector 400.

Also, the rotor 300 have two engaging arms 320 on opposite ends, adapted to engage two second arms 730 of the neutral position restoration means 700 at the time of depressing the second arms 730.

The neutral position restoration means 700, as shown in FIGS. 2 and 3, includes the two coil portions 710, the first arm portion 720 connecting between ends of the two coil portions 710, and two second arm portions 730 integrally connected to the other ends of the two coil portions 710 and crossing the respective ends of the first arm portion 720 substantially in the shape of V.

The coil portions 710 are accommodated and held in the first and second coil accommodating concavities 122*a*, 131*b* of the casing 100 and a third accommodating concavities 521 of the pressing member 500.

The ends of the first arm portion 720 are guided by the outer surfaces of the two fixing arms 131*a*. The middle portion of the first arm portion 720 is accommodated in the space between the lower surface of the guide protrusion 172 and the upper surface of the switch accommodating portion 130. In this manner, the neutral position restoration means 700 is accommodated in the casing 100.

The two second arm portions 730, as shown in FIG. 2(*a*), abut the inside of the engaging arms 320 at the two ends of the rotor 300. In this manner, the neutral position restoration means 700 supports the rotor 300 at the neutral position.

The pressing member 500 is molded of plastics material and, as shown in FIGS. 2, 3 and 6, includes the pressing member main body 510 and the substantially rectangular frame 520 in which the pressing member main body 510 is formed.

The pressing member main body 510 includes a tabular journal portion 511 arranged at the lower end of the frame 520 and a head portion 512 of substantially circular section arranged at a distal end of the journal portion 511.

The head portion 512 is in contact with the slope 212*b*1 of the operating lever 200, and the pressing member main body 510 thereby supports the operating lever 200. Specifically, as shown in FIG. 2(*a*), the operating lever 200 is upstandingly held at the neutral position by being supported on the pressing member main body 510 and the two second arm portions 730 of the neutral position restoration means 700.

Also, the head portion 512, when pressed by the slope 212*b*1, moves toward the press switch 600 to depress a top portion of a second contact portion main body 651 of the press switch 600.

The journal portion 511 is adapted to be elastically deformed as the head portion 512 is pressed by the slope 212*b*1. This elastic deformation allows the head portion 512 to move toward the press switch 600.

The four corners of the frame 520 are protruded outward. The two upper corners are fixed in position on the respective two fixing arms 131*a*. The two lower corners are held between the two hill portions 122. Under this condition, the head portion 512 is positioned to face and abut the slope 212*b*1 of the depressing portion 212 of the operating lever 200.

The upper end of the frame 520 is shaped like a rod avoiding the interference with the depressing portion 212 of the operating lever 200 to move down by depression. The lower end of the frame 520, on the other hand, is tabular and has the journal portion 511 in its center.

In the middle of the outer surfaces of the two end portions of the frame 520, there are two substantially arcuate third accommodating concavities 521 integrally connected to the two first coil accommodating concavities 122*a* and the two second coil accommodating concavities 131*b*. The two end portions of the frame 520 are placed on two each of first, second and third support portions 132, 133, 134. Accordingly, the two first leg portions 642 of the first movable contact portion 640 and the four second leg portions 652 of the second movable contact portion 650 are held between the two end portions of the frame 520 and the first, second and third support portions 132, 133, 134. This is how the first and second movable contact portions 640, 650 are prevented from rising.

The third accommodating concavities 521 accommodate and hold different parts of the coil portions 710 of the neutral position restoration means 700.

As shown in FIGS. 3, 4 and 6, the press switch 600 includes a first fixed contact portion 610, two second fixed contact portions 620 and third fixed contact portions 630 (the first, second and third fixed contact portions are buried in the base portion 110), the first movable contact portion 640 in contact with the first fixed contact portion 610, and the second movable contact portion 650 covered over the first movable contact portion 640 and in contact with the second fixed contact portions 620.

A first end of the first fixed contact portion 610 is forked into two distal ends, which are exposed from the upper and lower ends, respectively, of the central part of the contact mounting portion 135 of the switch accommodating portion 130. The second end of the first fixed contact portion 610 is exposed from the second surface along the thickness of the base portion 110.

Meanwhile, a first one of the second fixed contact portions 620 has a first end thereof exposed from the bottom surface of the concavity of the first one of the first support portions 132, and a second end thereof exposed from the second surface in the thickness direction of the base portion 110.

The second one of the second fixed contact portions 620 has a first end thereof exposed from the bottom surface of the concavity of the second one of the second support portions 133 and a second end thereof exposed from the second surface in the thickness direction of the base portion 110.

The third fixed contact portion 630 has a first end thereof exposed from the central part of the contact mounting portion 135 and a second end thereof exposed from the second surface in the thickness direction of the base portion 110.

The first movable contact portion 640, as shown in FIG. 3, includes a substantially dome-like elastically deformable first contact portion main body 641, and two first leg portions 642 arranged at an interval of 180° on the outer peripheral edge of the first contact portion main body 641. The two first leg portions 642 are fitted in the two third support portions 134 of the switch accommodating portion 130. Under this condition, the first contact portion main body 641 is set on the contact mounting portion 135 of the switch accommodating portion 130 and brought into contact with the first ends of the forked first fixed contact portion 610.

The second movable contact portion 650 includes the substantially dome-like elastically deformable second contact portion main body 651 and the four second leg portions 652 arranged at intervals of 90° on the outer peripheral edge of the second contact portion main body 651.

The four second leg portions 652 are fitted in the concavities of two each of the first and second support portions 132, 133 of the switch accommodating portion 130. As a result, two of the four second leg portions 652 are brought into contact with the respective first ends of the two second fixed contact portions 620. Also, the four second leg portions 652 are elastically deformable.

As shown in FIG. 6(*a*), with the four second leg portions 652 supported by two each of the first and second support portions 132, 133 of the switch accommodating portion 130, the top portion of the second contact portion main body 651 is arranged to face the head portion 512 of the pressing member 500. That is, the top portion is directed in the direction substantially at right angles to the pressing-movement direction and the swinging direction of the operating lever 200 (i.e., the direction along the thickness of the casing 100). Specifically, the top portion of the second contact portion main body 651 constituting a depressible portion to be depressed by the head portion 512 of the pressing member 500.

Accordingly, upon depression of the top portion of the second contact portion main body 651 by the head portion 512 of the pressing member 500 as shown in FIG. 6(*b*), the four second leg portions 652 and the second contact portion main body 651 are elastically deformed, and the top portion of the second contact portion main body 651 comes into contact with the top portion of the first contact portion main body 641. As a result, the press switch 600 is turned on as a first stage.

Upon further depression of the top portion of the second contact portion main body 651 by the head portion 512 of the pressing member 500 as shown in FIG. 6(*c*), the four second leg portions 652, the second contact portion main body 651 and the first contact portion main body 641 are elastically deformed, and the top portion of the second contact portion main body 651 comes into contact with the first end of the third fixed contact portion 630 through the first contact portion main body 641. As a result, the press switch 600 is turned on as a second stage.

The position detector 400, as shown in FIGS. 3 and 4, includes contact portions 411, 412, 413 buried in the base portion 110 of the casing 100 and the brush 420 adapted to selectively contact the contact portions 411, 412, 413.

The contact portion 411 has a first end thereof exposed from the central part of the first surface of the base portion 110 and a second end thereof exposed from the second surface in the thickness direction of the base portion 110.

The contact portion 412 has a first end thereof exposed from one side of the contact portion 411 of the first surface of the base portion 110 and a second end thereof exposed from the second surface in the thickness direction of the base portion 110.

The contact portion 413 has a first end thereof exposed from the other side of the contact portion 411 of the first surface of the base portion 110 and a second end thereof exposed from the second surface in the thickness direction of the base portion 110.

The brush 420 is a substantially arcuate conductive member and includes a body 421 to be mounted on the rotor 300 and two contact arms 422 integrally connected to the respective two ends of the body 421.

The body 421 has two mounting holes to be welded to the second surface in the thickness direction of the rotor 300.

The contact arms 422 each have a semi-arcuate curved distal end portion. The forward end portions of the contact arms 422 slide on the first surface of the base 110 in accordance with the swing motion of the rotor 300 and selectively slide on the first ends of the contact portions 411, 412, 413.

The frame ground 800 is formed of a metal plate. As shown in FIG. 3, the ground frame 800 includes a substantially pentagonal tabular base plate 810 with a round top, two upper engaging pieces 820 provided on the opposite sides of the top of the base plate 810, two lower engaging pieces 830 provided toward the lower end of the base plate 810 and below the upper engaging pieces 820, and two side wall plates 840 arranged at the respective opposite ends of the base plate 810.

The base plate 810 is in contact with the four protrusions 213 of the operating lever 200 and the frame 520 of the pressing member 500. As a result, the operating lever 200, the rotor 300, the brush 420 of the position detector 400, the pressing member 500 and the press switch 600 are held between the base plate 810 and the casing 100.

The upper engaging pieces 820 are each include a rectangular tabular part to fit in the concavity of the corresponding upper engaging portion 151, and an engaging hole arranged in the center of the tabular part to engage the engaging protrusion of the upper engaging portion 151. The lengths of the tabular parts of the upper engaging pieces 820 are larger than those of the upper engaging portions 151. Therefore, with the engaging hole engaging the engaging protrusion, the distal ends of the tabular parts are projected from the second surface of the base portion 110.

The lower engaging pieces 830 are shaped substantially the same as the upper engaging pieces 820.

The distal end portions of the upper engaging pieces 820 and the lower engaging pieces 830 are soldered to the ground pattern of the circuit board of a digital camera not shown. As a result, the static electricity charged on the operating lever 200 is received by the base plate 810 and the upper engaging pieces 820, and through the upper engaging pieces 820 and the lower engaging pieces 830, is released to the ground pattern.

The side wall plates 840 are adapted to contact the outer surfaces of the side wall portions 140. As a result, the side wall plates 840 close the openings above the side wall portions 140 and between the bottom wall portion 120 on and the inclined wall portions 150.

Hereinafter, assembly steps of the compound operation input device having the above configuration is explained. First, when molding parts of the casing 100 from plastics material, the first fixed contact portion 610, the two second fixed contact portions 620 and the third fixed contact portion 630 of the press switch 600 and the contact portions 411, 412, 413 of the position detector 400 are insert molded.

In this molding process, the distal end portions of the forked first ends of the first fixed contact portion 610 are exposed from the upper and lower ends, respectively, of the central part of the contact mounting portion 135 of the switch accommodating portion 130, while the second end thereof is exposed from the second surface in the thickness direction of the base portion 110. The first end of the first one of the second fixed contact portions 620 is exposed from the bottom surfaces of the concavity of the first one of the first support portions 132, while the second end thereof is exposed from the second surface in the thickness direction of the base portion 110. The first end of the second one of the second fixed contact portions 620 is exposed from the bottom surface of the concavity of the second one of the second support portions 133, and the second end thereof is exposed from the second surface in the thickness direction of the base portion 110. The first end of the third fixed contact portion 630 is exposed from the central part of the contact mounting portion 135, and the second end thereof is exposed from the second surface in the thickness direction of the base portion 110.

Also, the first end of the contact portion 411 is exposed from the central part of the first surface of the base portion 110, and the second end thereof is exposed from the second surface in the thickness direction of the base portion 110. The first end of the contact portion 412 is exposed from the one side of the contact portion 411 in the first surface of the base portion 110, and the second end thereof is exposed from the second surface in the thickness direction of the base portion 110. The first end of the contact portion 413 is exposed from the other side of the contact portion 411 in the first surface of the base portion 110, and the second end thereof is exposed from the second surface in the thickness direction of the base portion 110.

After that, the two first leg portions 642 of the first movable contact portion 640 of the press switch 600 are positioned and inserted in the respective two third support portions 134 of the switch accommodating portion 130 of the casing 100. Then, the first contact portion main body 641 of the first movable contact portion 640 is set on the contact mounting portion 135 of the switch accommodating portion 130 and comes into contact with the first ends of the forked first fixed contact portion 610.

After that, the four second leg portions 652 of the second movable contact portion 650 of the press switch 600 are positioned and inserted in the respective concavities of two each of the first and second support portions 132, 133 of the switch accommodating portion 130. Then, the two of the four second leg portions 652 come into contact with the first ends of the two second fixed contact portions 620. In this manner, the second movable contact portion 650 is covered over the first movable contact portion 640.

After that, the upper two corners of the frame 520 of the pressing member 500 are fitted between the two fixing arms 131*a*, while at the same time fitting the lower two corners of the frame 520 between the two hill portions 122. Then, the pressing member 500 is fixed in position between the two fixing arms 131 and the hill portions 122.

Then, the head portion 512 of the pressing member 500 is arranged to face the second movable contact portion 650 of the press switch 600. At the same time, the two end portions of the frame 520 are placed on two each of the first, second and third support portions 132, 133, 134. As a result, the two first leg portions 642 of the first movable contact portion 640 and the four second leg portions 652 of the second movable contact portion 650 are held between the two end portions of the frame 520 and the first, second and third support portions 132, 133, 134.

After that, the coil portions 710 of the neutral position restoration means 700 are positioned and inserted in the two third accommodating concavities 521 of the pressing member 500 and two each of the first and second coil accommodating concavities 122*a*, 131*b* of the casing 100. At the same time, the first arm portion 720 of the neutral position restoration means 700 is guided by the two fixed arms 131 of the casing 100 and accommodated in the space between the lower surface of the guide protrusion 172 and the upper surface of the switch accommodating portion 130.

After that, the rotor 300 with the brush 420 mounted thereon is positioned and inserted in the guide portion 170 of the casing 100. Then, the brush 420 comes into contact with the first surface of the base portion 110 of the casing 100.

After that, the mounting portion 211 of the operating lever 200 is inserted by being set in position with respect to the mounting concavity 310 of the rotor 300. Then, the slope 212*b*1 of the operating lever 200 comes into contact with the head portion 512 of the pressing member 500.

After that, the upper engaging pieces 820 of the frame ground 800 are made to engage the upper engaging portions 151 of the casing 100, while at the same time bringing the lower engaging pieces 830 of the frame ground 800 into engagement with the lower engaging portions 122*b* of the casing 100.

As a result, the operating lever 200, the rotor 300, the brush 420 of the position detector 400, the pressing member 500 and the first and second movable contact portions 640, 650 of the press switch 600 are held between the frame ground 800 and the casing 100.

After that, the second ends of the contact portions 411, 412, 413 of the position detector 400 are soldered to the associated electrode patterns of the circuit board, not shown, of the digital camera, while the second ends of the first fixed contact portion 610, the two second fixed contact portions 620 and the third fixed contact portion 630 of the press switch 600 are soldered to other electrode patterns of the circuit board on the other hand.

At the same time, the distal ends of the upper engaging pieces 820 and the lower engaging pieces 830 of the frame ground 800 are soldered to the associated ground patterns of the circuit board.

Hereinafter, how to use the compound operation input device assembled in the above described steps and how to operate each part thereof are explained. First, we will describe a case where the operating lever 200 is swung in the first swinging direction from the neutral position as shown in FIGS. 1(*c*) and 2(*c*). In accordance with the swing of the operating lever 200, the rotor 300 is swung in the first swinging direction.

Then, the two contact arms 422 of the brush 420 come into contact with the contact portions 411, 412, respectively. As a result, a signal is output to the digital camera, in which a zoom-up function is activated.

In the above swinging operation, the first end of the rotor 300 presses the first one of the second arm portions 730 of the neutral position restoration means 700. As a result, the first coil portion 710 is compressed.

After that, when the operating lever 200 is released, the urging force of the first coil portion 710 causes the second arm portion 730 to push back the first end of the rotor 300 in the second swinging direction. As a result, the operating lever 200 and the rotor 300 are returned to the neutral position.

Secondly, when the operating lever 200 is swung in the second swinging direction from the neutral position, the rotor 300 swings in the second swinging direction together with the operating lever 200.

Then, the two contact arms 422 of the brush 420 come into contact with the contact portions 411, 413, respectively. As a result, a signal is output to the digital camera, in which a zoom-back function is activated.

In this swinging operation, the second end of the rotor 300 presses the second one of the second arm portions 730 of the neutral position restoration means 700, so that the second coil portion 710 is compressed.

After that, when the operating lever 200 is released, the urging force of the second coil portions 710 causes the second one of the second arm portions 730 to push back the second end of the rotor 300 in the first swinging direction. As a result, the operating lever 200 and the rotor 300 are returned to the neutral position.

Thirdly, we will describe a case where the operating lever 200 is depressed from the neutral position as shown in FIG. 6(*b*). Upon the depression, the slope 212*b*1 of the operating lever 200 presses the head portion 512 of the pressing member 500. Then, the journal portion 511 of the pressing member 500 is elastically deformed, while the head portion 512 moves toward the press switch 600. Then, the head portion 512 depresses the top portion of the second contact main body 651 of the second movable contact portion 650 of the press switch 600.

As a result, the four second leg portions 652 and the second contact portion main body 651 are elastically deformed, and the top portion of the second contact portion main body 651 comes into contact with the top portion of the first contact portion main body 641. As a result, the first fixed contact portion 610, the two second fixed contact portions 620 and the first and second movable contact portions 640, 650 are electrically conducted, and a signal is output to the digital camera. In this way, the press switch 600 turns on as a first stage, and the auto-focus function of the digital camera is activated.

After that, when the operating lever 200 is released, the second contact main body 651, the four second leg portions 652 and the journal portion 511 are restored. This restoration force moves the head portion 512 in the direction away from the press switch 600, and pushes up the slope 212*b*1 of the operating lever 200 toward the neutral position. As a result, the operating lever 200 is restored to the neutral position.

Upon further depression of the operating lever 200 as shown in FIG. 6(*c*), the slope 212*b*1 of the operating lever 200 presses the head portion 512 of the pressing member 500. Then, the journal portion 511 of the pressing member 500 is elastically deformed, while the head portion 512 moves toward the press switch 600.

Then, the head portion 512 depresses the top portion of the first contact portion main body 641 through the top portion of the second contact portion main body 651. As a result, the four second leg portions 652, the second contact portion main body 651 and the first contact portion main body 641 are elastically deformed, and the top portion of the second contact portion main body 651 comes into contact with the exposed part of the first end of the third fixed contact portion 630 through the first contact portion main body 641. As a result, the first fixed contact portion 610, the two second fixed contact portions 620, the third fixed contact portion 630 and the first and second movable contact portions 640, 650 are electrically conducted, with the result that the signal thereof is output to the digital camera. In this way, the press switch 600 is turned on as the second stage (i.e. the shutter switch of the digital camera is turned on).

After that, when the operating lever 200 is released, the first contact main body 641, the second contact main body 651, the four second leg portions 652 and the journal portion 511 are restored. This restoration force moves the head portion 512 in the direction away from the press switch 600, and the slope 212*b*1 of the operating lever 200 is pushed up toward the neutral position.

In the compound operation input device as embodied above, the depressing operation of the operating lever 200 causes the head portion 512 of the pressing member 500 to move toward the press switch 600 so as to depress and elastically deform the second movable contact portion 640 or the first and second movable contact portions 640, 650 of the press switch 600. As a result, the input device is improved in provide a tactile touch in depressing operation.

In addition, the pressing member 500 is arranged under the operating lever 200. The press switch 600 is arranged to face the pressing member 500, with the top portion of the second movable contact portion 650 directed in the thickness direction of the casing 100. As a result, the operating lever 200 and the pressing member 500 can be vertically arranged, and the pressing member 500 and the press switch 600 can be arranged in juxtaposition in the thickness direction of the casing 100. These arrangements can suppress the increase in both height and thickness which otherwise might be caused by the provision of the press switch 600 in the compound operation input device.

Further, the neutral position restoration means 700 includes the two coil portions 710 and first and second arm portions 720, 730, while the coil portions 710 and the second arm portions 730 are arranged on opposite sides of the operating lever 200. Therefore, the central part of the lower end of the casing 100 can be used as the space for accommodating the pressing member 500 and the press switch 600. These arrangements can further suppress the increase in both height and thickness which otherwise might be caused by the provision of the press switch 600 in the compound operation input device.

Embodiment 2

Figure 8:
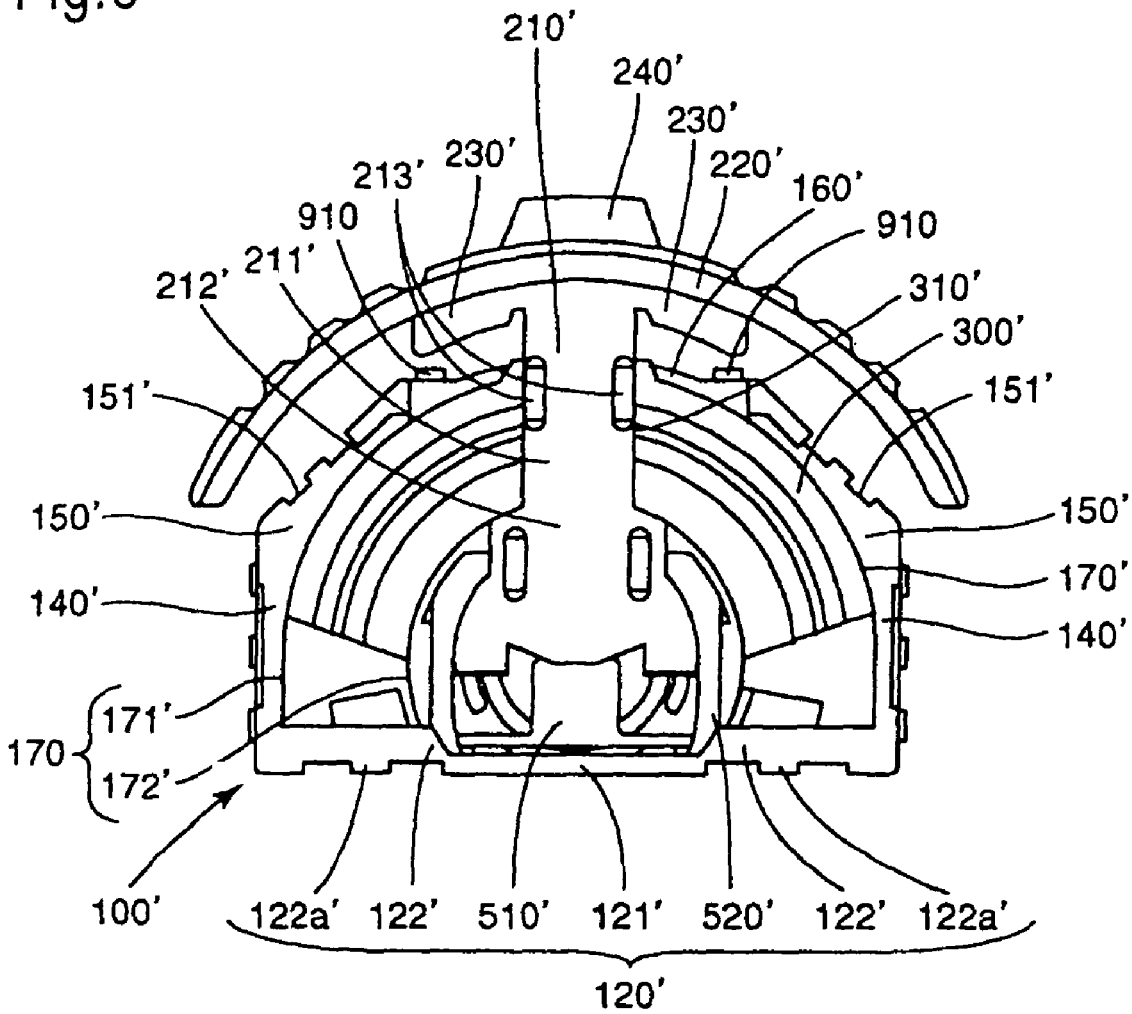
FIG. 8 is a schematic front view showing a state where the frame ground of the device is removed.
Figure 10:
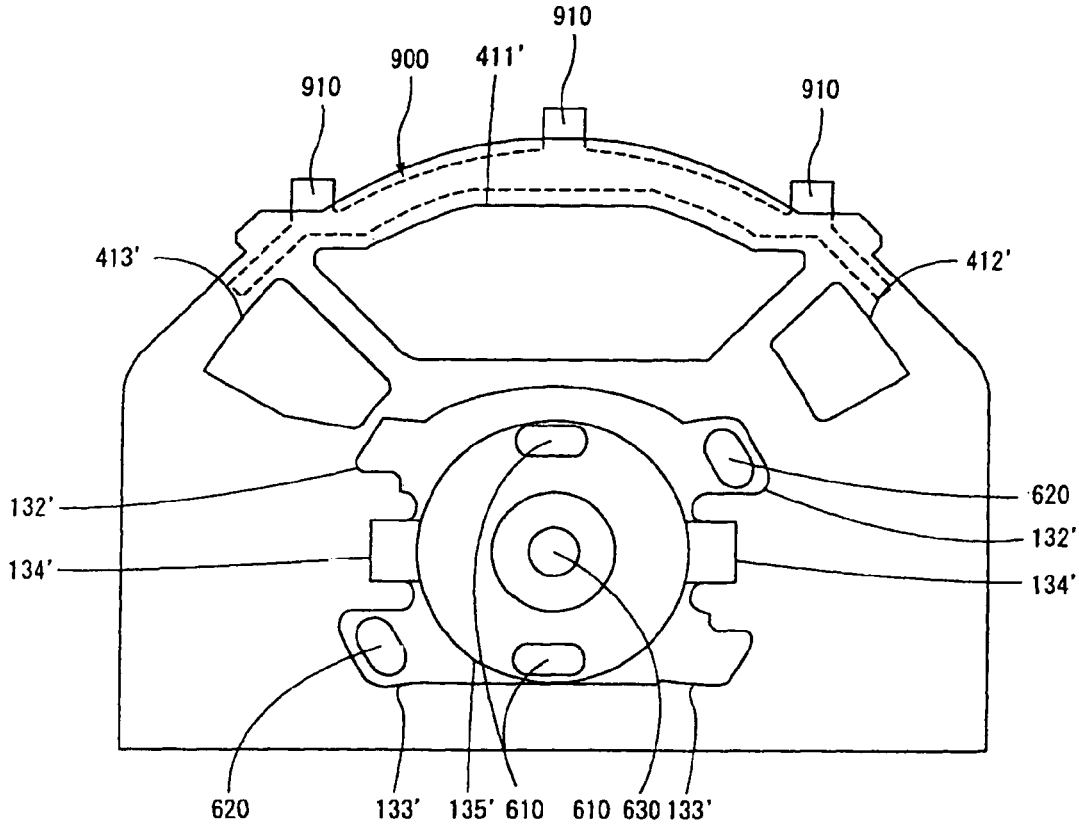
FIG. 10 is a schematic diagram of the case showing the exposed portions of the fixed contact portions of the push-down switch, the contact portions of the position detecting device and the earth terminals of the device.
Figure 11:
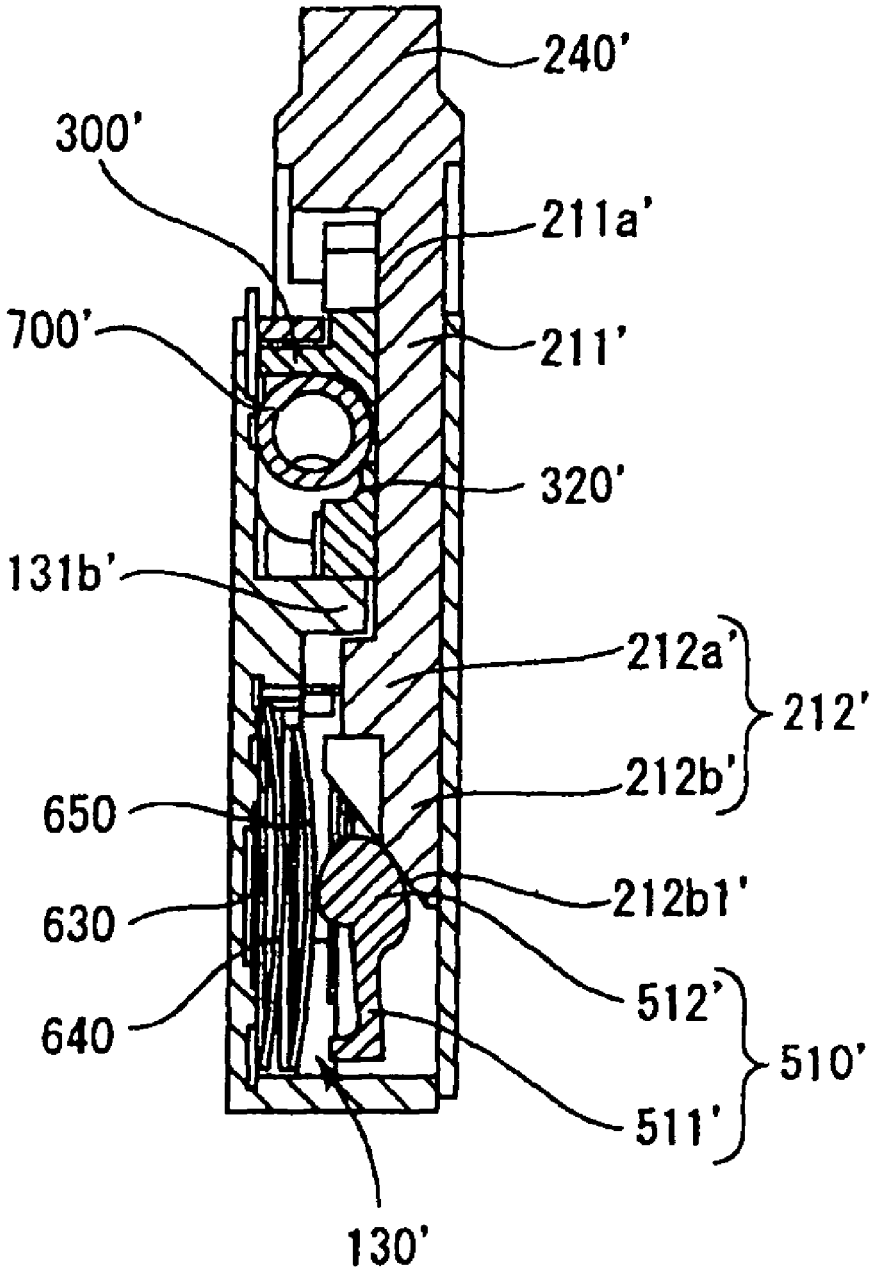
FIG. 11 is a sectional view of the device taken in line B-B in FIG. 7 of the device.

Next, a compound operation input device according to a second embodiment of the present invention will be hereinafter explained with reference to the drawings. FIG. 7 is a diagram showing the compound operation input device according to the second embodiment of the present invention. In FIG. 7, (a) is a schematic front view, (b) a schematic rear view, (c) a schematic side view, and (d) a schematic bottom view. FIG. 8 is a schematic front view showing a state where the frame ground of the device removed, and FIG. 9 an exploded perspective view of the device. FIG. 10 is a schematic diagram of the casing showing the exposed parts of the fixed contact portion of the press switch and the contacts and the ground terminal of the position detector of the device. FIG. 11 is a sectional view of the device taken in line B-B in FIG. 7.

The compound operation input device according to this embodiment is different from the compound operation input device according to the first embodiment in the shapes of a casing 100', an operating lever 200', a rotor 300', a brush 420' of a position detector 400', a pressing member 500' and a neutral position restoration means 700', and also different in that the compound operation input device according to this embodiment further includes the ground terminal 900. These differences will be explained in more detail below, while the same component elements as those in the first embodiment are not described. The component members different from those of the first embodiment are designated by different reference numerals, respectively, than those of the first embodiment.

Figure 9:
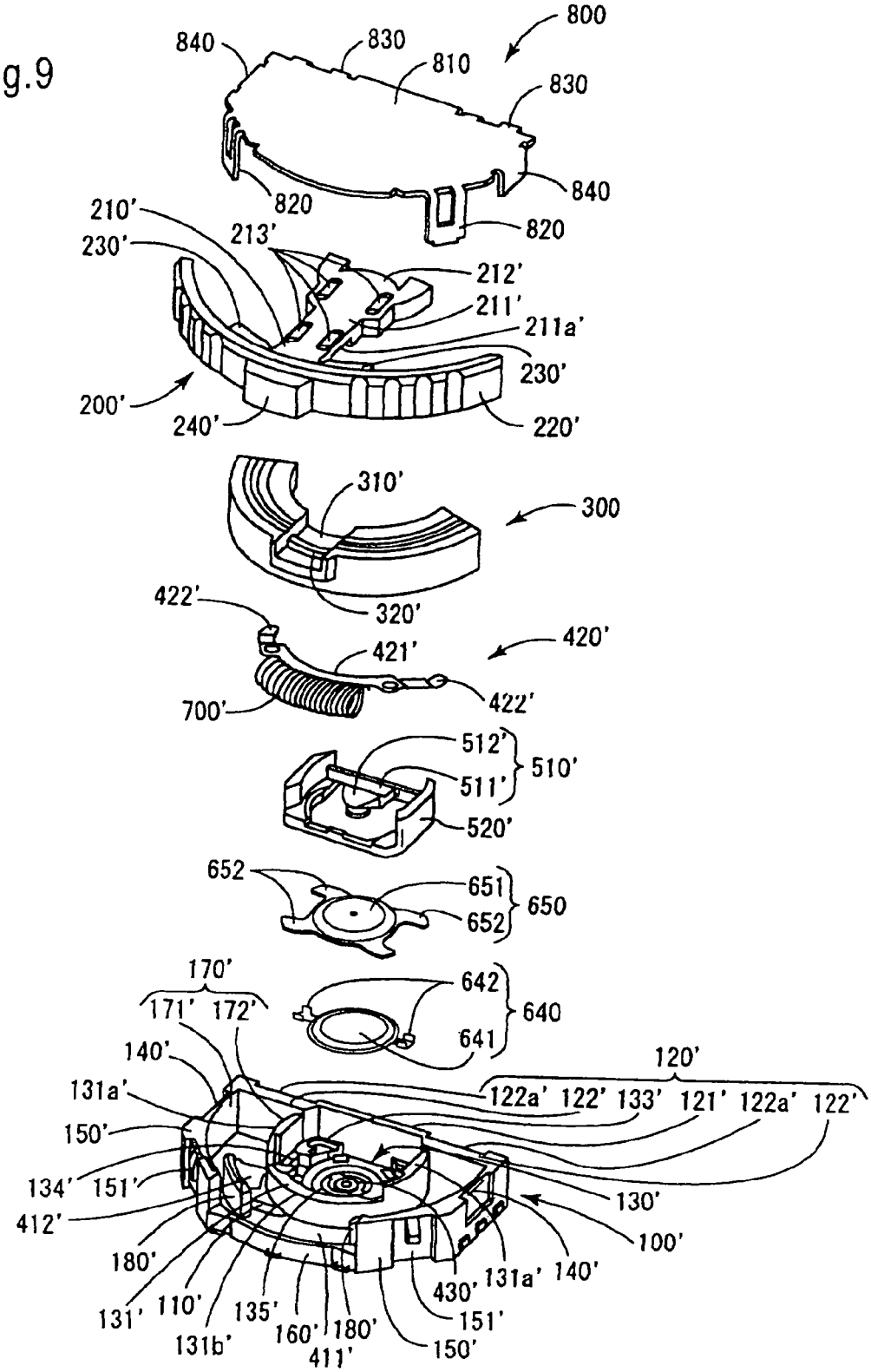
FIG. 9 is an exploded perspective view of the device.

The casing 100', as shown in FIGS. 7, 8 and 9, includes a substantially pentagonal tabular base portion 110' with a round top, a bottom wall portion 120' arranged at the lower end of the first surface in the thickness direction of the base portion 110', a switch accommodating portion 130' arranged in the center of the first surface of the base portion 110', two side wall portions 140' arranged on the respective two ends of the first surface of the base portion 110', two inclined wall portions 150' arranged on the respective slopes of the first surface of the base portion 110', an arcuate wall portion 160' arranged at the top of the first surface of the base portion 110', a guide portion 170' for guiding the rotor 300 swingably in the same direction as the operating lever 200, and two abutting portions 180' arranged below the two inclined wall portions 150' and on the first surface of the base portion 110'.

The bottom wall portion 120' includes a rectangular first bottom plate portion 121' located in the center of the lower end of the first surface in the thickness direction of the base portion 110, and rectangular second bottom plate portions 122' with stepped portions integrally connected to the opposite ends of the first bottom plate portion 121.

On the lower surfaces of the second bottom plate portions 122', there are lower engaging portions **122*a*' adapted to engage lower engaging pieces 830 of a frame ground 800. Also, the stepped portions of the second bottom plate portions 122' have slopes conforming with the shapes of the lower corners of a frame 520' of the pressing member 500'**.

The lower engaging portions **122*a*' are so shaped as to include rectangular concavities formed on the lower surfaces of the second bottom plate portions 122'** and engaging protrusions formed in the centers of the concavities.

The outer surfaces of the inclined wall portions 150' have upper engaging portions 151' for engaging upper engaging pieces 820 of the frame ground 800. The upper engaging portions 151' each have a rectangular concavity formed on the upper surface of the corresponding inclined wall portion 150' and an engaging protrusion formed in the center of the concavity.

The side wall portions 140' are integrally connected to the second bottom plate portions 122' of the bottom wall portions 120' and the inclined wall portions 150'. The outer surface of each side wall portion 140' has a concavity for receiving a corresponding side wall plate 840 of the frame ground 800.

The switch accommodating portion 130', as shown in FIG. 9, has a different shape of a ridge 131' from the ridge of the switch accommodating portion 130.

The ridge 131' is substantially semi-circular and includes two side arcuate portions **131*a*', and a central arcuate portion 131*b*' provided between the side arcuate portions 131*a*'**.

The height of the side arcuate portions **131*a*' is smaller than those of the bottom wall portion 120', the side wall portions 140' and the inclined wall portions 150'. Also, the inner surfaces of the side arcuate portions 131*a*' are as flat as outer end surface of the frame 520' of the pressing member 500'**.

The height of the central arcuate portion **131*b*' is about half the heights of the side arcuate portions 131*a*'. The opposite end portions of the central arcuate portion 131*b*' are sloped conforming in shape with the outer end surfaces of the frame 520' of the pressing member 500'**.

The guide portion 170' includes a substantially semi-circular first guide surface 171' provided as the inner surfaces of the side wall portions 140', inclined wall portions 150' and the arcuate wall portion 160', and a substantially semi-circular second guide surface 172' provided as the outer surface of the ridge 131' for guiding the rotor 300' swingably between itself and the first guide surface 171'.

The abutting portions 180' are substantially arcuate protrusions. The abutting portions 180' serve as the second abutting portions to abut the remaining portions of the lengthwise end surfaces of the neutral position restoration means 700'.

The rotor 300', as shown in FIG. 9, is of arcuate shape similar to the rotor 300. The central part of the first surface in the width direction of the rotor 300' is formed with a mounting concavity 310' for receiving a notch portion **211*a*' of a mounting portion 211' of the operating lever 200'** in a vertically movable manner.

In the second surface in the width direction of the rotor 300', as shown in FIGS. 9 and 11, there are formed a substantially arcuate accommodating concavity 320' communicating with the mounting concavity 310', and two substantially arcuate guide concavities, not shown, communicating with the respective opposite lengthwise ends of the accommodating concavity 320'.

The accommodating concavity 320' is a groove for accommodating the neutral position restoration means 700'. The lengthwise end surfaces of this accommodating concavity 320' serve as the first abutting portions to abut portions of the lengthwise ends of the neutral positional restoration means 700'.

The guide concavities are grooves for receiving the abutting portions 180' of the casing 100' movably in the two swinging directions of the operating lever 200'. Specifically, in accordance with the swing of the operating lever 200' and the rotor 300', the abutting portions 180' moves in the guide concavities and enter into the accommodating concavity 320' so as to press portions of the end surfaces of the neutral position restoration means 700'.

The second surface of the rotor 300' is formed with two bosses, not shown, to be welded to the two mounting holes of a body 421' of the brush 420' of the position detector 400'.

The neutral position restoration means 700' is a substantially arcuate coil spring as shown in FIGS. 9 and 11. This neutral position restoration means 700' is accommodated in the accommodating concavity 320' of the rotor 300' and held between the two abutting portions 180'. Since the neutral position restoration means 700' is held between the two abutting portions 180' in this manner, the rotor 300' is held at the neutral position.

The operating lever 200', as shown in FIGS. 9 and 11, has a different shape of mounting portion 211' of a shaft portion 210' from the mounting portion of the operating lever 200. The mounting portion 211' includes the substantially rectangular notch portion 211*a*' formed on the second surface in the thickness direction thereof.

The length of the notch portion 211*a*' is larger than the length of the mounting concavity 310'. The notch portion 211*a*' is fitted vertically movably in the mounting concavity 310' and between the side arcuate portions 131*a*' of the switch accommodating portion 130'. As shown in FIG. 11, the lower edge of the notch portion 211*a*' is located below and abuttable against the central arcuate portion 131*b*' of the switch accommodating portion 130'. In other words, the lower edge of the notch portion 211*a*' functions as a stopper for preventing the operating lever 200 from coming off upward.

The pressing member 500' has a different shape of frame 520' from the frame of the pressing member 500. Specifically, the end portions of the frame 520' are shaped to conform to the slopes of the central arcuate portion 131*b*', the inner surfaces of the two side arcuate portions 131*a*' and the slope of the stepped portions of the second bottom plate portions 122' of the bottom wall portion 120'. In other words, the frame 520' can be fitted and held in the switch accommodating portion 130' of the casing 100'.

The two end portions of the frame 520' are also mounted on two each of first, second and third support portions 132', 133', 134', so that two first leg portions 642 of a first movable contact portion 640 and four second leg portions 652 of a second movable contact portion 650 are sandwichingly held between the end portions of the frame 520' and the first, second and third support portions 132', 133', 134'. In this manner, the first and second movable contact portions 640, 650 is prevented from rising.

The position detector 400' has a different shape of brush 420' from the brush of the position detector 400. The brush 420' is a substantially arcuate member longer than the brush 420. The distal end portions of contact arms 422' are bent in the thicknesswise direction of the casing 100'.

The ground terminal 900 is a metal plate buried in the base portion 110. The ground terminal 900 includes three charging portions 910 projected from the upper end of the base portion 110, and a ground connecting portion, not shown, exposed from the second surface of the base portion 110 and soldered to the ground pattern of the circuit board.

Hereinafter, descriptions will be made on assembly steps of the compound operation input device according to the second embodiment as described above. First, when molding parts of the casing 100' from plastics material, a first fixed contact portion 610, two second fixed contact portions 620 and third fixed contact portion 630 of a press switch 600, contact portions 411', 412', 413' of the position detector 400' and the ground terminal 900 are insert molded.

In this molding process, the charging portions 910 of the ground terminal 900 are projected from the upper end of the base portion 110' and the ground connecting portion thereof is exposed from the second surface of the base portion 110. It should be noted that assembly steps of the first fixed contact portion 610, the two second fixed contact portion 620, the third fixed contact portion 630 and the contact portions 411', 412', 413' of the position detector 400' are similar to those of the first embodiment and will not be described again.

After that, like in the first embodiment, the first and second movable contact portions 640, 650 of the press switch 600 are accommodated in the switch accommodating portion 130'.

After that, the frame 520' of the pressing member 500' is positioned and inserted in the switch accommodating portion 130' of the casing 100'. Then, a head portion 512' of the pressing member 500' is arranged to face the top portion of the second movable contact portion 650 of a press switch 600. At the same time, the two end portions of the frame 520' are arranged on two each of the first, second and third support portions 132', 133', 134'. As a result, the two first leg portions 642 of the first movable contact portion 640 and the four second leg portions 652 of the second movable contact portion 650 are held between the end portions of the frame 520' and the first, second and third support portions 132', 133' and 134'.

Then, the neutral position restoration means 700' is positioned and inserted in the accommodating concavity 320' of the rotor 300'. The lengthwise end of the accommodating concavity 320' are brought into abutment against portions of the lengthwise ends of the neutral position restoration means 700'.

Under this condition, the two abutting portions 180' of the casing 100' are positioned and inserted in the two guide concavities of the rotor 300'. Then, the rotor 300' is fitted in the guide portion 170' of the casing 100', and the two abutting portions 180' are brought into abutment against the remaining portions of the lengthwise ends of the neutral position restoration means 700'.

After that, the notch portion 211*a*' of the operating lever 200' is positioned and inserted into the mounting concavity 310' of the rotor 300' and between the side arcuate portions 131*a*' of the switch accommodating portion 130' of the casing 100'.

After that, the frame ground 800 is mounted on the casing 100' in a similar manner as in the first embodiment. As a result, each component member described above is held between the frame ground 800 and the casing 100'.

After that, the second ends of the contact portions 411', 412', 413' of the position detector 400' are soldered to the associated electrode patterns of the circuit board, not shown, of the digital camera, and the second ends of the first fixed contact portion 610, the two second fixed contact portions 620 and the third fixed contact portion 630 of the press switch 600 soldered to other electrode patterns of the circuit board.

At the same time, the distal end portions of the upper and lower engaging pieces 820, 830 of the frame ground 800 and the ground connecting portion of the ground terminal 900 are soldered to the associated ground patterns of the circuit board.

Hereinafter, how to use the compound operation input device assembled in the above described steps and how to operate each part thereof are explained. First, we will describe a case where the operating lever 200' is swung in the first swinging direction. In accordance with the swing of the operating lever 200', the rotor 300' swings in the first swinging direction.

Then, the two contact arms 422' of the brush 420' come into contact with the contact portions 411', 412', respectively, of the position detector 400'. Thus, a signal is output to the digital camera, in which a zoom-up function is activated.

In the above swinging operation, the first abutting portions 180' of the casing 100' moves from the first guide concavity of the rotor 300' into the accommodating concavity 320' and presses the portion of the first lengthwise end surface of the neutral position restoration means 700'. As a result, the neutral position restoration means 700' is compressed between the first abutting portions 180' and the second end surface of the accommodating concavity 320'.

After that, when the operating lever 200' is released, the urging force of the neutral position restoration means 700' pushes back the second end surface of the accommodating concavity 320' in the second swinging direction. As a result, the operating lever 200' and the rotor 300' are returned to the neutral position.

Secondly, when the operating lever 200' is swung in the second swinging direction, the rotor 300' swings in the second swinging direction together with the operating lever 200'.

Then, the two contact arms 422' of the brush 420' come into contact with the contact portions 411', 413', respectively. As a result, a signal is output to the digital camera, in which a zoom-back function is activated.

In this swinging operation, the second abutting portions 180' of the casing 100' moves from the second guide concavity of the rotor 300' into the accommodating concavity 320' and presses the portion of the second lengthwise end surface of the neutral position restoration means 700'. As a result, the neutral position restoration means 700' is compressed between the second abutting portions 180' and the first end surface of the accommodating concavity 320'.

After that, when the operating lever 200' is released, the urging force of the neutral position restoration means 700' pushes back the first end surface of the accommodating concavity 320' in the first swinging direction. As a result, the operating lever 200 and the rotor 300' are returned to the neutral position.

The depressing operation of the operating lever 200' and actions of each element during the depressing operation are similar to those in the first embodiment and therefore not described again.

In the compound operation input device as described as Embodiment 2 above, the depressing operation of the operating lever 200' causes the head portion 512' of the pressing member 500 to move toward the press switch 600 so as to depress and elastically deform the second movable contact portion 640 or the first and second movable contact portions 640, 650 of the press switch 600. As a result, the input device is improved in providing a tactile touch in depressing operation.

In addition, the pressing member 500' is arranged under the operating lever 200'. The press switch 600 is arranged to face the pressing member 500', with the top portion of the second movable contact portion 650 directed in the thickness direction of the casing 100'. As a result, the operating lever 200' and the pressing member 500' can be arranged vertically, and the pressing member 500' and the press switch 600 can be arranged in juxtaposition in the thickness direction of the casing 100'. These arrangements can suppress the increase in both height and thickness which otherwise might be caused by the provision of the press switch 600 in the compound operation input device.

Further, since the neutral position restoration means 700' is accommodated in the accommodating concavity 320' of the rotor 300', the central part of the lower end of the casing 100' can be used as the space for accommodating the pressing member 500' and the press switch 600. These arrangements can further suppress the increase in both height and thickness which otherwise might be caused by the provision of the press switch 600 in the compound operation input device.

Embodiment 3

Figure 12:
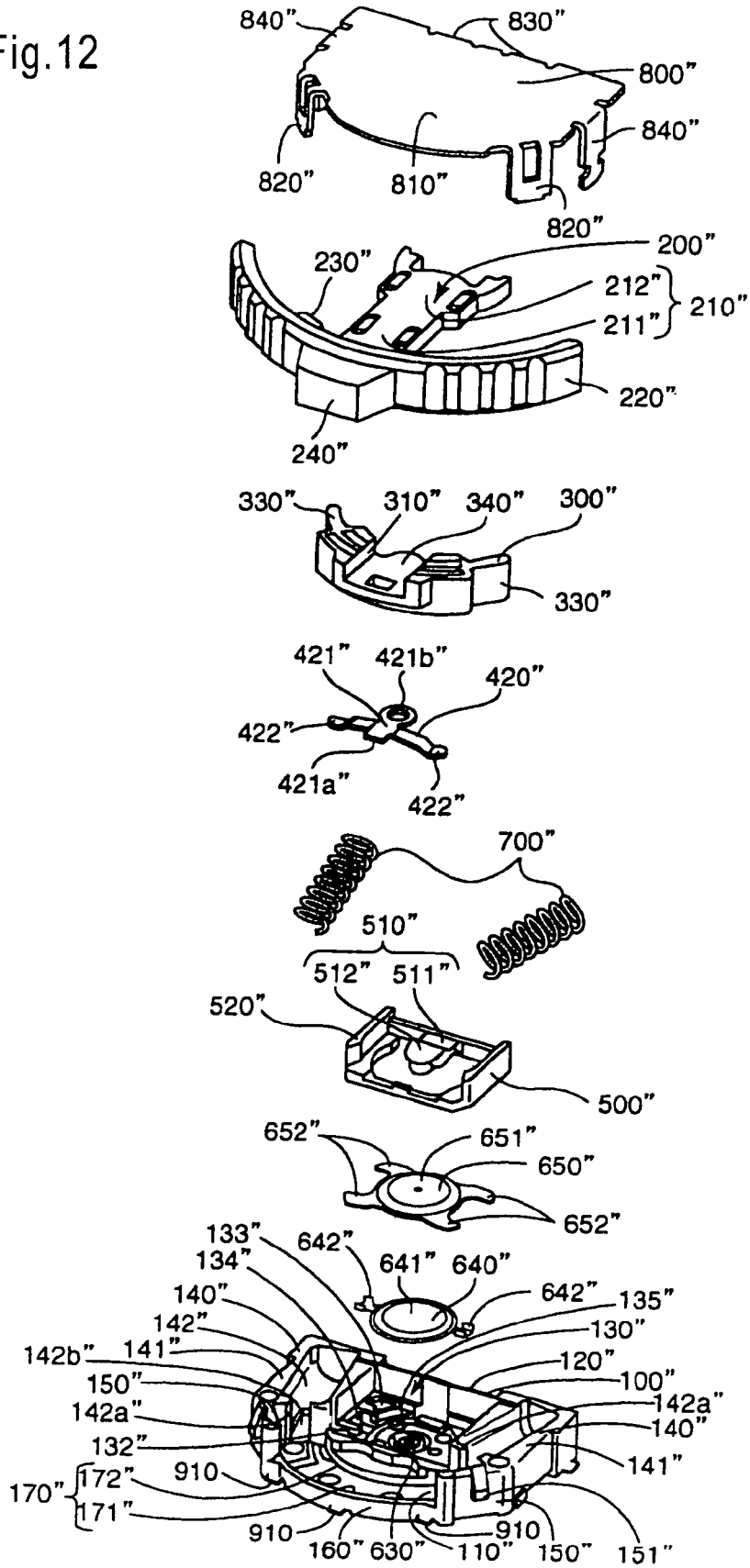
FIG. 12 is an exploded perspective view showing the compound operation input device according to a third embodiment of the present invention.
Figure 14D:
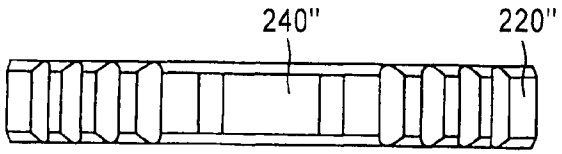
FIG. 14D is a plan view.
Figure 14A:
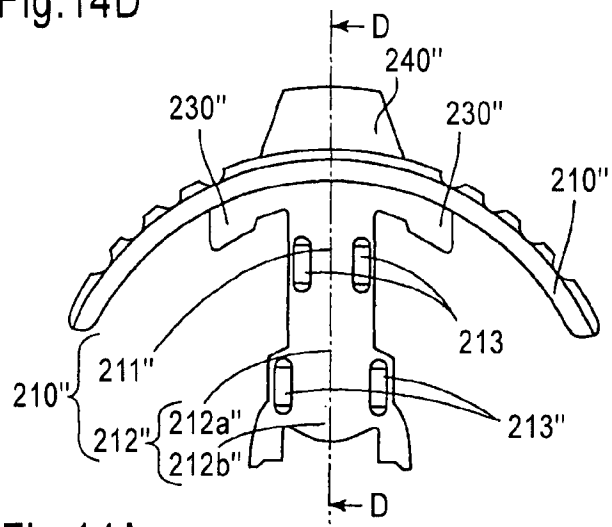
FIG. 14A is a front view.
Figure 14E:
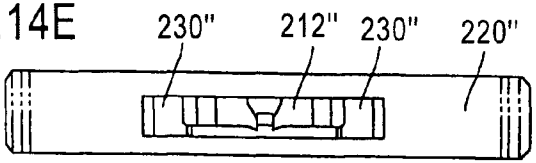
FIG. 14E is a bottom view.
Figure 14B:
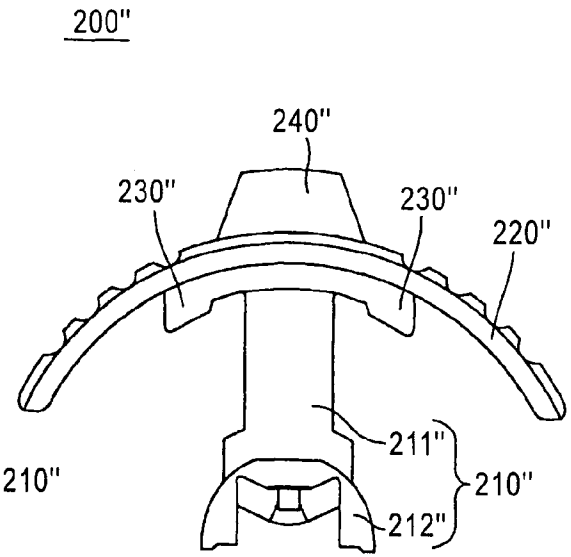
FIG. 14B is a rear view.
Figure 14C:
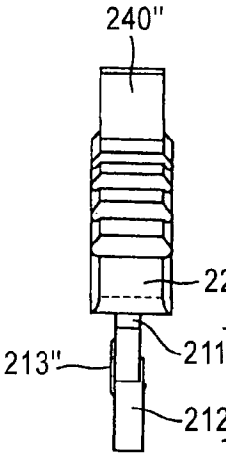
FIG. 14C is a side view.
Figure 14F:
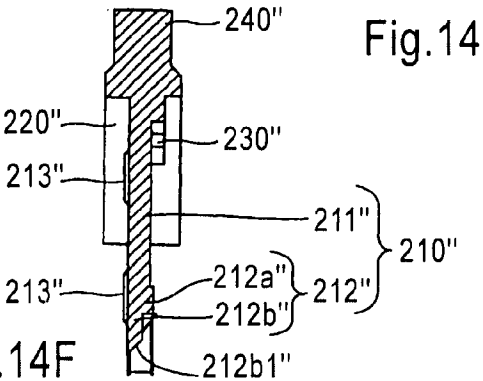
FIG. 14F is a sectional view taken in line D-D.
Figure 15D:
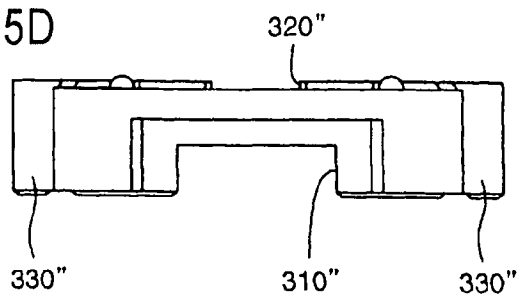
FIG. 15D is a plan view.
Figure 15A:
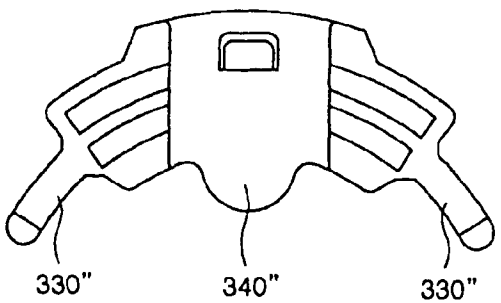
FIG. 15 is a diagram showing the rotor of the device, in which FIG. 15A a front view.
FIG. 15B is a rear view.
FIG. 15C is a side view.
FIG. 15E is a bottom view.
Figure 15E:
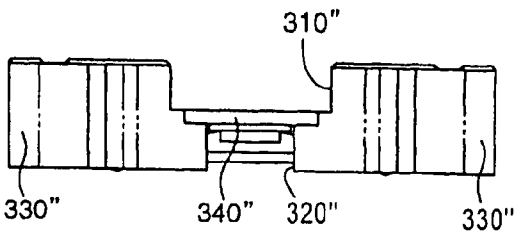
Figure 15C:
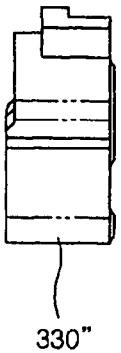
Figure 15B:
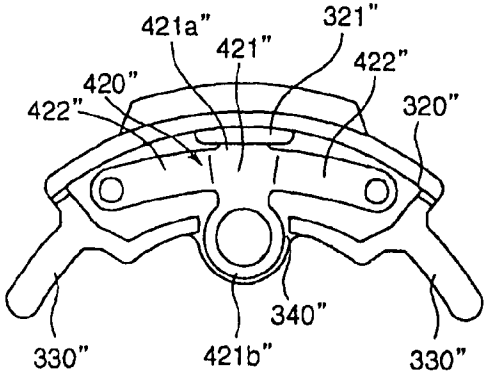
Figure 16D:
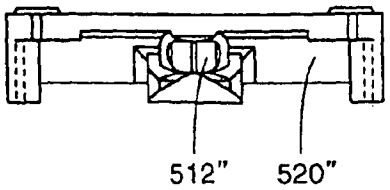
FIG. 16D is a plan view.
Figure 16A:
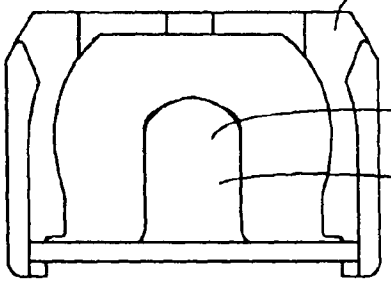
FIG. 16 is a diagram sowing the depression member of the device, in which FIG. 16A a front view.
FIG. 16B is a rear view.
FIG. 16C is a side view.
FIG. 16E is a bottom view.
Figure 16C:
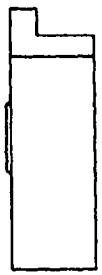
Figure 16E:
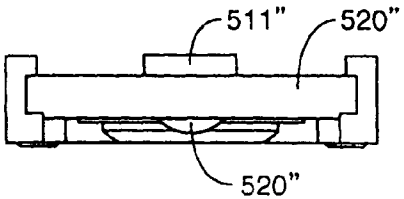
Figure 16B:
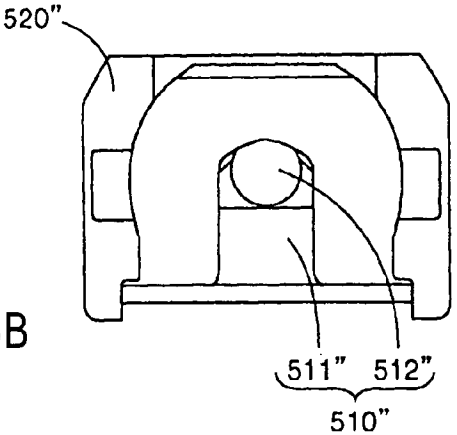
Figure 17A:
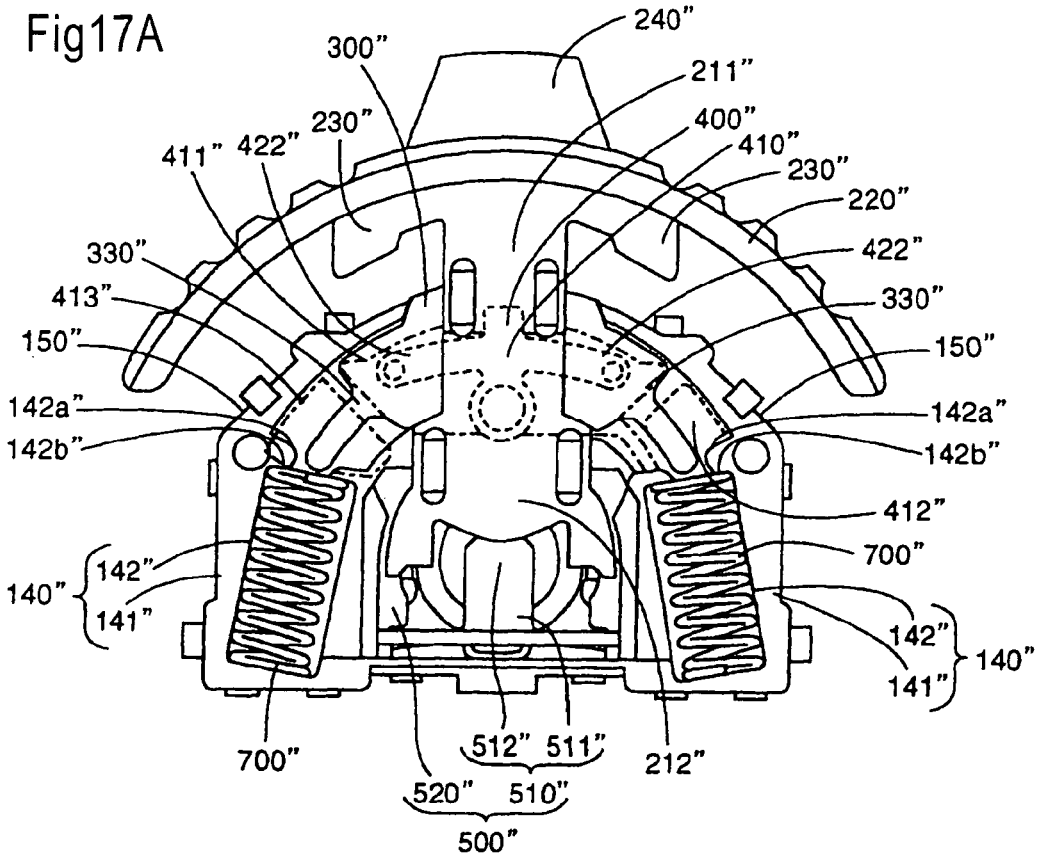
FIG. 17A is a diagram showing a state where the operating lever is located at the origin.
Figure 17B:
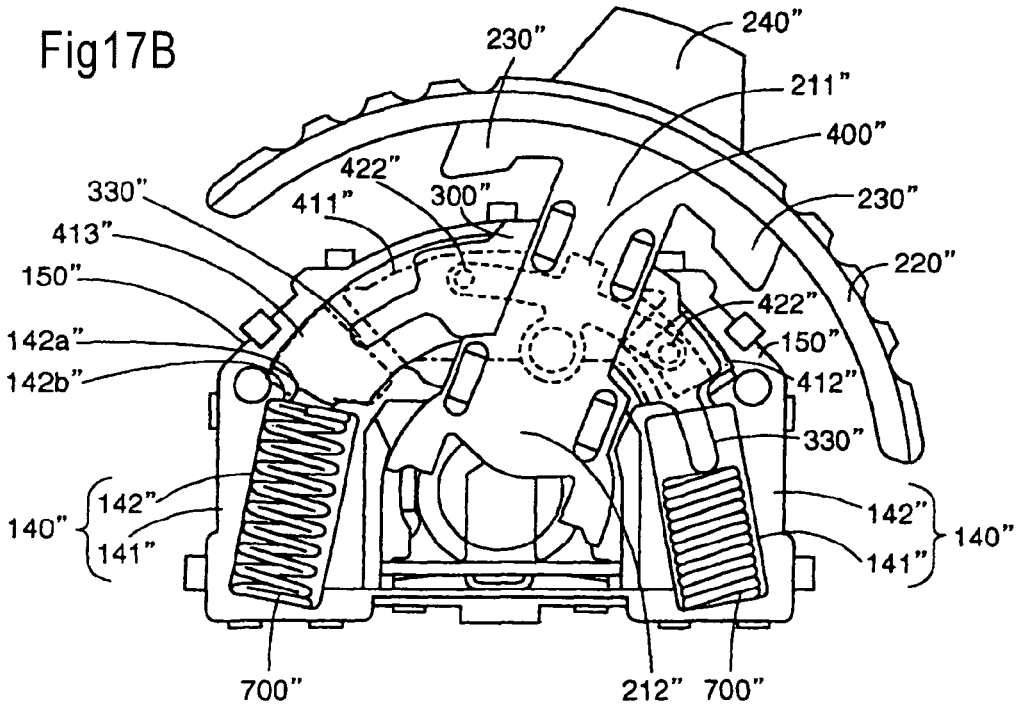
FIG. 17B is a diagram showing a state where the operating lever is in swing operation.

Hereinafter, the compound operation input device according to a third embodiment of the present invention is explained with reference to the drawings. FIG. 12 is an exploded perspective view showing the compound operation input device according to the third embodiment of the present invention, FIG. 13 a diagram of a casing showing a fixed contact portion of a press switch, contacts of a position detector and ground terminal of the device. In FIG. 13, (a) is a front view, (b) a sectional view taken in line C-C, and (c) a partly enlarged view in (b). FIG. 14 is a diagram showing an operating lever for the device. In FIG. 14, (a) is a front view, (b) a rear view, (c) a side view, (d) a plan view, (e) a bottom view, and (f) a sectional view taken in line D-D. FIG. 15 is a diagram showing a rotor of the device. In FIG. 15, (a) is a front view, (b) a rear view, (c) a side view, (d) a plan view, and (e) a bottom view. FIG. 16 is a diagram showing a pressing member of the device. In FIG. 16, (a) is a front view, (b) a rear view, (c) a side view, (d) a plan view, and (e) a bottom view. FIG. 17 is a schematic front view showing a state where the frame ground of the device is removed. In FIG. 17, (a) is a diagram showing a state where the operating lever is located at the neutral position, and (b) a diagram showing a state where the operating lever is in swing operation. FIG. 18 is a diagram of the casing showing the fixed contact portion of another press switch, the contacts of the position detector and the ground terminal of the device. In FIG. 18, (a) is a front view, (b) a sectional view taken in line E-E, and (c) a partly enlarged view in (b).

The compound operation input device according to this embodiment is mainly different from the compound operation input device according to the first embodiment in the shape of a casing 100", an operating lever 200", a rotor 300", a brush 420" of a position detector 400", a pressing member 500", fixed contact portions of a press switch 600" and a frame ground 800". The compound operation input device according to this embodiment is also different in including two neutral position restoration means 700" and a ground terminal 900. These differences are described in detail below, while the same component elements are not described any more. Incidentally, the reference numerals referring to the different members are accompanied by " for distinction from the first and second embodiments.

The casing 100", as shown in FIGS. 12 and 13, includes a substantially pentagonal tabular base portion 110" with a round top, a bottom wall portion 120" arranged in the center of the lower end of a first surface in the thickness direction of the base portion 110", a switch accommodating portion 130" arranged in the center of the first surface of the base portion 110", two spring accommodating portions 140" arranged at the respective two ends of the switch accommodating portion 130" of the first surface of the base portion 110", two inclined wall portions 150" arranged on the respective slopes of the first surface of the base portion 110", an arcuate wall portion 160" arranged at the top of the first surface of the base portion 110" and a guide portion 170" for guiding the rotor 300 swingably in the same direction as the operating lever 200.

The second surface in the thickness direction of the base portion 110" has eight connecting concavities 111" for projecting second end portions of contact portions 411", 412", 413" of the position detector 400" and the second ends of a first fixed contact portion 610", two second fixed contact portions 620" and a third fixed contact portion 630" of the press switch 600" out of the casing 100".

The connecting concavities 111" form spaces between themselves and a circuit board of a digital camera with the casing 100" set on the circuit board. These spaces receive solder to connect between the circuit board and the second end portions of the contact portions 411", 412", 413" of the position detector 400" and the second end portions of the first fixed contact portion 610", the two second fixed contact portions 620" and the third fixed contact portion 630" of the press switch 600". By pouring solder into these spaces in this way, the second end portions of the contact portions 411", 412", 413" of the position detector 400" and the second ends of the first fixed contact portion 610", the two second fixed contact portions 620" and the third fixed contact portion 630" of the press switch 600" are electrically connected to the circuit board and the casing 100" is mechanically connected strongly to the circuit board.

The bottom wall portion 120" is a rectangular tabular member.

The spring accommodating portions 140" include prism portions 141" of substantially cuboid shape integrally connected to the ends of the bottom wall portion 120", and accommodating portion main parts 142" recessingly formed in the respective prism portions 141" for accommodating the neutral position restoration means 700".

Openings 142*a*" are formed in the center of the upper ends of the accommodating portion main parts 142". The bottom surfaces of the accommodating portion main parts 142" are formed with substantially arcuate guide grooves 142*b*" communicating with the openings 142*a*". The guide grooves 142*b*" swingably guide arm portions 330" of the rotor 300".

Edges of the openings 142*a*" at the upper end of the accommodating portion main part 142" are abuttable against two end surfaces of the rotor 300". Specifically, the edges of the accommodating portion main parts 142" constitute stoppers to prevent the rotor 300" from swinging to a degree more than predetermined.

The switch accommodating portion 130" has a different shape of ridge 131" from the ridge of the switch accommodating portion 130.

The ridge 131" has a substantially square frame arranged along the bottom wall portion 120" and the two spring accommodating portions 140".

The guide portion 170" includes an arcuate guide surface 171" provided on the inner surface of the arcuate wall portion 160" and a substantially semi-cylindrical guide protrusion 172" integrally formed with the top of the ridge 131". The rotor 300" is swingably held between the guide surface 171" and the guide protrusion 172".

The second thicknesswise end of the guide protrusion 172" has a corrugated notch to avoid interference with a ring portion 421*b*" of the brush 420" of the position detector 400" and a tabular portion 340" of the rotor 300".

The neutral position restoration means 700", as shown in FIGS. 12 and 17, are coil springs to be accommodated in the accommodating portion main parts 142" of the spring accommodating portions 140".

The rotor 300" is a substantially arcuate member as shown in FIGS. 12, 15 and 17. The rotor 300" has a mounting concavity 310" in the center of the first surface in the width direction. The mounting concavity 310" receives a mounting portion 211" of the operating lever 200" movably in the vertical direction.

The second surface in the width direction of the rotor 300" is formed with a substantially arcuate accommodating concavity 320" for accommodating the brush 420" of the position detector 400". In the center of the upper end of the accommodating concavity 320", there is provided a press-fitting portion 321" for press-fitting therein a press-fitting plate 421*a*" of the brush 420". The central part of the lower end of the accommodating concavity 320" is open to let out the ring portion 421*b*" of the brush 420".

The two ends of the rotor 300" have two arm portions 330" extending in the two swinging directions. The arm portions 330" intrude into the guide grooves 142*b*" from the openings 142*a*" of the spring accommodating portion 140" and come into contact with the neutral position restoration means 700". As a result, the rotor 300" is held at the neutral position.

The two ends of the rotor 300" are adapted to contact the two edges of the accommodating portion main part 142" of the two spring accommodating portions 140.

The lower end of the rotor 300" has the substantially semicircular tabular portion 340" for guiding the ring portion 421*b*" of the brush 420" projected from the accommodating concavity 320".

As shown in FIGS. 12, 14 and 17, The operating lever 200" is different from the operating lever 200 in the shape of the back of the mounting portion 211" and in that the back of a depressing portion 212" is somewhat larger than the mounting portion 211".

The pressing member 500", as shown in FIGS. 12, 16 and 17, has a different shape of frame member 520" from the frame member of the pressing member 500. Specifically, the outer surfaces of the two end portions of the frame 520" form flat surfaces conforming in shape to the inner wall surfaces of the prism portions 141" of the two spring accommodating portions 140". In other words, the frame 520' is fitted and held between the two spring accommodating portions 140" of the casing 100'.

The two end portions of the frame 520" are similarly mounted on two each of first, second and third support portions 132", 133", 134", and two first leg portions 642" of a first movable contact portion 640" and four second leg portions 652" of a second movable contact portion 650" are held between the two end portions of the frame 520" and the first, second and third support portions 132", 133", 134". In this way, the first and second movable contact portions 640", 650" are prevented from rising.

The position detector 400" has the contact portions 411", 412", 413" and the brush 420" in different shapes from those of the position detector 400.

The contact portion 411" has a first end thereof exposed from the central part of the first surface of the base portion 110. The second end of the contact portion 411" is forked. The first branch of the fork is projected from a first end of the base portion 110" of the casing 100", and the second branch thereof is projected from the connecting concavity 111" of a lower end of the base portion 110" of the casing 100" and bent upward along the first spring accommodating portion 140".

A first end of the contact portion 412" is exposed from the first surface of the base portion 110, specifically on a first side of the contact portion 411. A second end of the contact portion 412" is projected from the connecting concavity 111" toward the first end of the base portion 110" of the casing 100" and bent upward along the first spring accommodating portion 140".

A first end of the contact portion 413" is exposed also from the first surface of the base portion 110, specifically on a second side of the contact portion 411. A second end of the contact portion 413" is projected from the connecting concavity 111" toward a second end of the base portion 110" of the casing 100" and bent upward along the second spring accommodating portion 140".

The brush 420", as shown in FIGS. 12 and 17, includes a body 421" to be mounted on the rotor 300" and two contact arms 422" integrally connected to the respective two ends of the body 421".

The body 421" has the press-fitting plate 421*a*" protrudingly provided at the upper end thereof and the ring portion 421*b*" at the lower end thereof. The press-fitting plate 421*a*" is to be press-fitted into the press-fitting portion 321" of the rotor 300, so that the brush 420" is held in the accommodating concavity 320".

The distal ends of the contact arms 422" are bent in the thickness direction of the casing 100".

The press switch 600", as shown in FIGS. 12 and 13, is different from the press switch 600 in the shape of the first fixed contact portion 610", the two second fixed contact portions 620" and the third fixed contact portion 630" buried in the base portion 110.

The first end portion of the first fixed contact portion 610" is forked into two branches, and the distal ends thereof are exposed from the upper and lower ends, respectively, of the central part of a contact mounting portion 135" of the switch accommodating portion 130". The second end of the first fixed contact portion 610" is projected from the connecting concavity 111" at the lower end of the base portion 110" of the casing 100" and bent upward along the bottom wall portion 120".

The first end of the first one of the second fixed contact portions 620" is exposed from a bottom surface of a concavity of the first one of the first support portions 132". The second end of the first one of the second fixed contact portion 620", on the other hand, is projected from the connecting concavity 111" at the lower end of the base portion 110" of the casing 100" and bent upward along the first one of the spring accommodating portions 140".

The first end of the second one of the second fixed contact portions 620" is exposed from a bottom surface of a concavity of the second one of the second support portions 133". The second end of the second one of the second fixed contact portions 620" is forked into two branches. The first branch is projected from the connecting concavity 111" of the lower end of the base portion 110" of the casing 100" and bent upward along the bottom wall portion 120". The second branch is projected from the connecting concavity 111" at the lower end of the base portion 110" of the casing 100" and bent upward along the second one of the spring accommodating portion 140".

The first end of the third fixed contact portion 630" is exposed from the central part of the contact mounting portion 135". The second end of the third fixed contact portion 630" is forked into two branches. The first branch is projected from the connecting concavity 111" of the lower end of the base portion 110" of the casing 100" and bent upward along the second one of the spring accommodating portions 140". The second branch is projected from the second end of the base portion 110" of the casing 100".

The frame ground 800", as shown in FIG. 12, is different from the frame ground 800 in that two lower engaging pieces 830" are arranged in the center of the lower end of the base plate 810" and in that two connecting arms 840" are arranged at the two ends of the base plate 810".

A first one of the lower engaging pieces 830" engages the second end of the first fixed contact portion 610. A second one of the lower engaging pieces 830" engages the second end of the first one of the second fixed contact portions 620.

The connecting arms 840" are connected by soldering to a ground pattern, not shown, of the circuit board. The widthwise ends of the connecting arms 840" have notches. During soldering process, the notches functions to keep heat of melted solder in distal end portions of the connecting arms 840".

The ground terminal 900 is a metal plate buried in the base portion 110. The ground terminal 900 includes the three charging portions 910 projected from the upper end of the base portion 110 and the ground connecting portion, not shown, exposed from the second surface of the base portion 110 and soldered to the ground pattern of the circuit board.

Hereinafter, descriptions will be made on assembly steps of the compound operation input device according to the third embodiment as described above. First, when molding parts of the casing 100' from plastics material, the first fixed contact portion 610", the two second fixed contact portions 620" and the third fixed contact portion 630" of the press switch 600", the contact portions 411", 412", 413" of the position detector 400" and the ground terminal 900 are insert molded. The second end portions of the first fixed contact portion 610", the two second fixed contact portions 620" and the third fixed contact portion 630" are bent upward as described above.

In this molding process, the first end of the contact portion 411" is exposed from the central part of the first surface of the base portion 110". The first branch of the forked second end of the contact portion 411" is projected from the first end of the base portion 110", and the second branch is projected from the connecting concavity 111" of the lower end of the base portion 110". The first end of the contact portion 412" is exposed from the first side of the contact portion 411 of the first surface of the base portion 110, and the second end thereof is projected from the connecting concavity 111" of the first end of the base portion 110". The first end of the contact portion 413" is exposed from the second side of the contact portion 411 of the first surface of the base portion 110, while the second end thereof is projected from the connecting concavity 111" of the second end of the base portion 110".

The distal end portions of the forked first end of the first fixed contact portion 610" are exposed from the upper and lower ends, respectively, of the central part of the contact mounting portion 135" of the switch accommodating portion 130", while the second end of the first fixed contact portion 610" is projected from the connecting concavity 111" at the lower end of the base portion 110". The first end of the first one of the second fixed contact portions 620" is exposed on the bottom surface of the concavity of the first one of the first support portions 132", while the second end thereof is projected from the connecting concavity 111" of the lower end of the base portion 110". The first end of the second one of the second fixed contact portions 620" is exposed on the bottom surface of the concavity of the second one of the second support portions 133", while the branches of the forked second end thereof are projected from the respective connecting concavities 111" at the lower end of the base portion 110".

The first end of the third fixed contact portion 630" is exposed from the central part of the contact mounting portion 135". The first branch of the forked second end of the third fixed contact portion 630" is projected from the connecting concavity 111" of the lower end of the base portion 110", while the second branch thereof is projected from the second end of the base portion 110".

The charging portions 910 of the ground terminal 900 are projected from the upper end of the base portion 110", and the ground connecting portion thereof is exposed from the second surface of the base portion 110".

After that, like in the first embodiment, the first and second movable contact portions 640", 650" of the press switch 600" are accommodated in the switch accommodating portion 130".

The frame 520" of the pressing member 500" is positioned and inserted between the two spring accommodating portions 140" of the casing 100". Then, a head portion 512" of the pressing member 500" is arranged to face the top portion of the second movable contact portion 650" of the press switch 600". At the same time, the two end portions of the frame 520" are mounted on two each of the first, second and third support portions 132", 133", 134". As a result, the two first leg portions 642" of the first movable contact portion 640" and the four second leg portions 652" of the second movable contact portion 650" are held between the two end portions of the frame 520" and the first, second and third support portions 132", 133", 134".

The two neutral position restoration means 700" are accommodated in the two spring accommodating portions 140" of the casing 100".

After that, the rotor 300" is fitted in the guide portion 170" of the casing 100". Then, the two arm portions 330" of the rotor 300" enter from the openings 142*a*" of the two spring accommodating portions 140" into the guide grooves 142*b*" and abut the two neutral position restoration means 700" accommodated in the spring accommodating portions 140".

After that, the operating lever 200" is fitted in the mounting concavity 310" of the rotor 300". Then, a slope 212*b*1" of the operating lever 200" comes into contact with the head portion 512" of the pressing member 500".

After that, two upper engaging pieces 820" of the frame ground 800" are engaged with two upper engaging portions 151" of the casing 100". At the same time, the two lower engaging pieces 830" of the frame ground 800" are engaged with the second end of the first fixed contact portion 610" and the first branch of the second end of the second one of the second fixed contact portions 620" exposed from the bottom wall portion 120" of the casing 100". As a result, these component members are held between the frame ground 800" and the casing 100".

After that, as shown in FIGS. 13(*b*) and 13(*c*), the casing 100" is set on the circuit board of the digital camera. Then, the solder is poured into the spaces between the eight connecting concavities 111" of the casing 100" and the circuit board. Thus, the second end portions of the contact portions 411", 412", 413" of the position detector 400" are soldered to associated electrode patterns of the circuit board, and so are the second end portions of the first fixed contact portion 610", the second fixed contact portions 620" and the third fixed contact portion 630" of the press switch 600" soldered to other electrode patterns of the circuit board. As a result, the casing 100" is fixed on the circuit board.

The distal ends of the upper and lower engaging pieces 820", 830" of the frame ground 800", the connecting arms 840" and the ground connecting portions of the ground terminal 900 are soldered to the ground pattern of the circuit board.

Hereinafter, how to use the compound operation input device assembled in the above described steps and how to operate each part thereof are explained. First, we will describe a case where the operating lever 200" is swung in the first swinging direction. In accordance with the swing of the operating lever 200", the rotor 300" swings in the first swinging direction.

Then, the two contact arms 422" of the brush 420" come into contact with the contact portions 411", 412", respectively, of the position detector 400". As a result, a signal is output to the digital camera, in which a zoom-up function is activated.

In the above swinging operation, one of the arm portions 330" of the rotor 300" moves into the spring accommodating portions 140" along the guide grooves 142*b*" of the first spring accommodating portion 140", and presses one of the neutral position restoration means 700". As a result, the neutral position restoration means 700" is compressed.

After that, when the operating lever 200" is released, the urging force of the neutral position restoration means 700" pushes back the rotor 300" in the second swinging direction. As a result, the operating lever 200 is restored to the neutral position.

Secondly, when the operating lever 200" is swung in the second swinging direction, the rotor 300" swings in the second swinging direction together with the operating lever 200".

Then, the two contact arms 422" of the brush 420" come into contact with the contact portions 411", 413", respectively. As a result, a signal is output to the digital camera, in which a zoom-back function is activated.

In this swinging operation, the other arm portion 330" of the rotor 300" moves into the spring accommodating portions 140" along the guide grooves 142*b*" of the other spring accommodating portions 140", and presses the other neutral position restoration means 700". As a result, the neutral position restoration means 700" is compressed.

After that, when the operating lever 200" is released, the urging force of the neutral position restoration means 700" pushes back the rotor 300" in the first swinging direction. As a result, the operating lever 200" is restored to the neutral position.

The depressing operation of the operating lever 200" and actions of each element during the depressing operation are similar to those in the first embodiment and therefore not described again.

In the compound operation input device as described as Embodiment 3 above, the depressing operation of the operating lever 200" causes the head portion 512" of the pressing member 500" to move toward the press switch 600" so as to depress and elastically deform the second movable contact portion 640" or the first and second movable contact portions 640", 650" of the press switch 600". As a result, the input device is improved in providing a tactile touch in depressing operation.

In addition, the pressing member 500" is arranged under the operating lever 200". The press switch 600" is arranged to face the pressing member 500", with the top portion of the second movable contact portion 650" directed in the thickness direction of the casing 100". As a result, the operating lever 200" and the pressing member 500" can be arranged vertically, while the pressing member 500" and the press switch 600" can be arranged in juxtaposition in the thickness direction of the casing 100". These arrangements can suppress the increase in both height and thickness which otherwise might be caused by the provision of the press switch 600" in the compound operation input device.

Also, since the two neutral position restoration means 700" are accommodated in the two spring accommodating portions 140" at the ends of the casing 100', the central part of the lower end of the casing 100' can be used as the space for accommodating the pressing member 500" and the press switch 600". These arrangements can further suppress the increase in both height and thickness which otherwise might be caused by the provision of the press switch 600" in the compound operation input device.

Also, the second end protrusions of the contact portions 411", 412", 413" of the position detector 400" and the second end portions of the first fixed contact portion 610", the second fixed contact portions 620" and the third fixed contact portion 630" of the press switch 600" are soldered to the circuit board, and the connecting concavities 111" of the casing 100" is soldered to the circuit board. As a result, the compound operation input device can be fixed to the circuit board more securely.

It should be noted that the casings 100, 100' or 100" of any kind can be used as far as they are adapted to accommodate the other elements constituting the input device.

The connecting concavities 111" of the casing 100" can be changed in design as far as the concavity include spaces for receiving the solder between itself and a circuit board of an electronic device. Also, any number of the connecting concavities may be formed.

The frame grounds 800 or 800" may or may not be provided. In the absence, a cover member mountable on the casing 100, 100' or 100" may be used in place of the frame grounds 800 or 800". The ground terminal 900 also may or may not be provided.

The operating lever 200, 200' or 200" may be changed in design as desired as far as it is adapted for depressing operation and swinging operation in the two opposite swinging directions intersecting the pressing-movement direction.

The pressing members 500, 500' or 500" may be changed in design in any manner as far as it is arranged to face a first end surface (lower face) of the operating lever in the pressing-movement direction and as far as the pressing members 500, 500' or 500", upon depression by the first end surface of the operating lever, moves toward the press switch and presses the depressible portion of the press switch.

For example, the pressing member may be formed as a movable member to be guided by a guide groove in the casing so as to move in the thicknesswise direction of the casing. Upon depression by the first end surface of the operating lever, the movable member may move toward the press switch and press the depressible portion of the press switch.

The slope **212*b*1, 212*b*1' or 212*b*1" according to the above embodiments are formed on the lower surface of the depression portion 212, 212' or 212" of the operating levers 200, 200' or 200"** (i.e. formed on the aforementioned end surface of the operating lever on the pressing-movement direction side). Alternatively, the slope may be provided on the surface of the pressing member facing the operating lever. Still alternatively, the slope may be formed in both the end surface of the operating lever on the pressing-movement direction side and the surface of the pressing member facing the operating lever.

Also, in the case where at least one of the end surface of the operating lever on the pressing-movement direction side and the surface of the pressing member facing the operating lever is substantially spherical, then the pressing member can be moved toward the press switch even without the slope.

The rotors 300, 300' or 300" may be omitted. In the absence of the rotor 300, the operating lever 200 may have two arm portions at its two ends so that these arm portions may come into contact with the respective two second arm portion 730. In the absence of the rotor 300', on the other hand, the mounting portion 211' of the operating lever 200' may be provided with the first contact portion in place of concavity 320' adapted to contact portions of the two ends along the length of the neutral position restoration means 700'. In the absence of the rotor 300", the operating lever 200" may have two arm portions at its two ends so that these arm portions may come into contact with the respective two neutral position restoration means 700".

The accommodating concavity 320' may be formed on the casing 100'. In such a case, the contact portions 180' are arranged on the rotor 300'. Also, the guide concavities may be omitted if a portion along the thickness of the neutral position restoration means 700' is accommodated in the accommodating concavity 320' and the remaining portions exposed from the accommodating concavity 320' are brought into contact with the contact portions 180'.

The neutral position restoration means 700, 700' or 700" may be also omitted. Also, the neutral position restoration means 700 can be formed into two members by cutting its first arm portion 720. In this case, the first arm portion 720 is made to engage the casing. With regard to the neutral position restoration means 700' or 700", the coil springs may be replaced by springs of another kind, or elastic members made of rubber, elastomeric resin, etc.

The position detector 400, 400', 400", though described above as consisting of three contact portions and a brush, may be of any other kind as far as the swing position of the operating lever can be detected.

As an example of an alternative position detector, a variable resistor may be used by arranging a resistance pattern instead of the contact portions on the base portions 110, 110' or 110" and sliding the brush thereon. Alternatively, a proximity switch such as a magnetic switch activated in accordance with the swing of the operating lever may be used. Incidentally, there may be provided with six or more contact portions to be selectively contacted by the brush so as to support three or more inputs.

The contact portions 411", 412" or 413" may be of other shape. As shown in FIG. 18, for example, the second end portions of the contact portions 411", 412" or 413" may be extended along the circuit board, and the distal end portions thereof may be bent so as to contact the circuit board. The contact portions 411, 412, 413 and the contact portions 411', 412', 413' may be similarly changed in shape.

The press switch 600 or 600" of any kind may be used as far as it can be activated by depression by the pressing member. Also, the press switches 600 or 600" may be replaced by a press switch with only one depression stage, having the second and third fixed contact portions 620, 630, 620", 630" and the first movable contact portions 640, 640". Also, the press switch may be adapted for three or more stages with four or more fixed contact portions and three or more movable contact portions.

Any design change may be done in the shape of the second end portions of the first fixed contact portion 610", the two second fixed contact portions 620" and the third fixed contact portion 630". As shown in FIG. 18, for example, the second end portions of the first fixed contact portion 610", the two second fixed contact portions 620" and the third fixed contact portion 630" can be so shaped as to be extended along the circuit board with the distal end thereof bent so as to contact the circuit board. This is also the case with the second end portions of the first fixed contact portion 610, the two second fixed contact portions 620 and the third fixed contact portion 630. Incidentally, the second fixed contact portions described above may alternatively be one instead of two in number.

The compound operation input device is described as one to be mounted on a digital camera. The input device may alternatively be mounted on another electronic device.

What is claimed is:

1. A compound operation input device comprising:

a casing;

an operating lever accommodatable in the casing in such a manner that the operating lever is depressingly operable from a neutral position in a pressing-movement direction and swingingly operable from the neutral position in two opposite swinging directions intersecting the pressing-movement direction;

a position detector accommodatable in the casing and adapted to output a signal in accordance with a swing angle of the operating lever;

a pressing member facing an end surface of the operating lever on the pressing-movement direction side; and a press switch facing the pressing member with a depressible portion of the press switch facing a direction substantially orthogonal to the pressing-movement direction and the swinging directions of the operating lever, wherein the pressing member is adapted to move toward the press switch when pressed by the end surface of the operating lever so as to depress the depressible portion of the press switch.

2. The compound operation input device according to claim 1, wherein at least one of the end surface of the operating lever and a surface of the pressing member facing the operating lever forms a slope for moving the pressing member toward the press switch upon depression of the operating lever.

3. The compound operation input device according to claim 1, further comprising two neutral position restoring members having resilience, being abuttable against the operating lever from the two swinging direction sides for holding the operating lever at the neutral position.

4. The compound operation input device according to claim 3, the two neutral position restoring members including:

two coil portions arranged on the two swinging direction sides of the operating lever in the casing, and two arm portions extending from the respective coil portions, and wherein the two arm portions are adapted to be pressed against associated opposite end portions in the swinging direction of the operating lever in response to a swinging motion of the operating lever so as to compress the respective two coil portions.

5. The compound operation input device according to claim 4, further comprising a substantially arcuate rotor, the operating lever coupled thereto movably in the pressing-movement direction of the operating lever, the rotor being held in the casing swingably together with the operating lever, wherein the two arm portions are adapted to be pressed against associated two end portions of the rotor in response to a swinging motion of the operating lever so as to compress the respective two coil portions.

6. The compound operation input device according to claim 4 or 5, wherein the two neutral position restoring members are integrated by another arm portion extending from and coupling between the two coil portions.

7. The compound operation input device according to claim 5, further comprising a substantially arcuate rotor, the operating lever coupled thereto movably in the pressing-movement direction of the operating lever, the rotor being held in the casing swingably together with the operating lever, wherein the rotor includes an accommodating concavity for accommodating the neutral position restoring member with the remaining part thereof exposed, and wherein lengthwise opposite end surfaces of the accommodating concavity constitute the two first abutting portions.

8. The compound operation input device according to claim 3, further comprising a substantially arcuate rotor, the operating lever coupled thereto movably in the pressing-movement direction of the operating lever, the rotor being held in the casing swingably together with the operating lever, wherein the neutral position restoring members are adapted to abut respective two end portions of the rotor from the two swinging directions so as to hold the rotor at the neutral position.

9. The compound operation input device according to claim 5, 8 or 7, the position detector comprising:

a conductive brush arranged on the rotor and a plurality of contact portions arranged on the casing and selectively contacted by the conductive brush.

10. The compound operation input device according to claim 9, the plurality of the contact portions each including a first end portion exposed inside the casing and adapted to be contacted by the conductive brush and a second end portion projected out of the casing for external connection, wherein a plurality of connecting concavities for receiving solder is formed in portions of the casing from which the second end portions of the plurality of the contact portions are projected.

11. The compound operation input device according to claim 1, further comprising a neutral position restoring member having resilience for restoring the swinging-operated operating lever to the neutral position, wherein the operating lever includes two first abutting portions abuttable against portions of lengthwise opposite end surfaces of the neutral position restoring member, and wherein the casing includes two second abutting portions abuttable against the remaining portions of the two lengthwise end surfaces of the neutral position restoring member.

12. The compound operation input device according to claim 1, the press switch comprising:

first and second fixed contact portions arranged on the casing, and a substantially dome-shaped movable contact portion whose top portion serves as the depressible portion and whose peripheral edge portion is contactable with the first fixed contact portions, and wherein, upon depression of the pressing member, the movable contact portion is elastically deformed so that the top portion thereof is brought into contact with the second fixed contact portion.

13. The compound operation input device according to claim 12, wherein the pressing member is elastically deformable, and wherein once the movable contact portion is released from the depression of the operating lever, the pressing member and the movable contact portion are restored so as to push the operating lever toward the neutral position.

14. The compound operation input device according to claim 12, the first fixed contact portion including a first end portion exposed inside the casing to contact the peripheral edge portion of the movable contact portion and a second end portion projected out of the casing for external connection, the second fixed contact portion including a first end portion exposed in the casing and adapted to contact the movable contact portion and a second end portion projected out of the casing for external connection, and wherein a plurality of connecting concavities for receiving solder is formed in portions of the casing from which the second end portions of the first and second fixed contact portions are projected.

15. The compound operation input device according to claim 1, the press switch comprising:

first, second and third fixed contact portions arranged on the casing, a substantially dome-shaped first movable contact portion whose peripheral edge portion is contactable with the first fixed contact portion, and a substantially dome-shaped second movable contact portion disposed over the first movable contact portion, the peripheral edge of the second movable contact portion being contactable with the second fixed contact portion, wherein a second top portion of the second movable contact portion serves as the depressible portion, wherein upon depression of the second top portion by the pressing member, the second movable contact portions is elastically deformed and the second top portion thereof comes into contact with a first top portion of the first movable contact portion, and wherein upon further depression of the second top by the pressing member, the first and second movable contact portions are elastically deformed and the first top portion comes into contact with the third fixed contact portion.

16. The compound operation input device according to claim 15, wherein the pressing member is elastically deformable, wherein once the second movable contact portion is released from the depression of the operating lever, the pressing member and the second movable contact portion are restored so as to push the operating lever toward the neutral position, and wherein once the first and second movable contact portions are released from the depression of the operating lever, the pressing member and the first and second movable contact portions are restored so as to push the operating lever toward the neutral position.

17. The compound operation input device according to claim 15, the first fixed contact portion including a first end portion exposed inside the casing to contact the peripheral edge portion of the first movable contact portion, and a second end portion projected out of the casing for external connection, the second fixed contact portion including a first end portion exposed inside the casing to contact the peripheral edge portion of the second movable contact portion, and a second end portion projected out of the casing for external connection, the third fixed contact portion including a first end portion exposed in the casing in a way adapted to contact the first movable contact portion, and a second end portion projected out of the casing for external connection, and wherein a plurality of connecting concavities for receiving solder is formed in portions of the casing from which the second end portions of the first, second and third fixed contact portions are projected.

18. The compound operation input device according to claim 1, the position detector comprising:

a conductive brush arranged on the operating lever and a plurality of contact portions arranged on the casing and selectively contacted by the conductive brush.

19. The compound operation input device according to claim 18, the plurality of the contact portions each including a first end portion exposed inside the casing and adapted to be contacted by the conductive brush and a second end portion projected out of the casing for external connection, wherein a plurality of connecting concavities for receiving solder is formed in portions of the casing from which the second end portions of the plurality of the contact portions are projected.

20. The compound operation input device according to claim 1, further comprising a frame ground mountable on the casing to release static electricity charged on the operating lever outside the input device.

* * * * *